US010281142B2

(12) United States Patent
Matsumoto et al.

(10) Patent No.: US 10,281,142 B2
(45) **Date of Patent: *May 7, 2019**

(54) SOLID-FUEL-FIRED BURNER AND SOLID-FUEL-FIRED BOILER

(75) Inventors: Keigo Matsumoto, Tokyo (JP); Koutaro Fujimura, Tokyo (JP); Kazuhiro Domoto, Tokyo (JP); Toshimitsu Ichinose, Tokyo (JP); Naofumi Abe, Tokyo (JP); Jun Kasai, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/381,535

(22) PCT Filed: Jun. 7, 2010

(86) PCT No.: PCT/JP2010/059607

§ 371 (c)(1),
(2), (4) Date: Mar. 9, 2012

(87) PCT Pub. No.: WO2011/074281

PCT Pub. Date: Jun. 23, 2011

(65) Prior Publication Data

US 2012/0152158 A1 Jun. 21, 2012

(30) Foreign Application Priority Data

Dec. 17, 2009 (JP) ..... 2009-286663

(51) Int. Cl.
*F23D 1/00* (2006.01)
*F23C 6/04* (2006.01)

(52) U.S. Cl.
CPC ..... *F23D 1/00* (2013.01); *F23C 6/045* (2013.01); *F23C 2201/101* (2013.01); *F23C 2201/20* (2013.01)

(58) Field of Classification Search
CPC ... F23D 1/00; F23D 1/005; F23D 1/02; F23D 1/04; F23D 1/06; F23D 2201/00;
(Continued)

(56) References Cited

U.S. PATENT DOCUMENTS 1,747,522 A * 2/1930 Marchand ..... F23C 99/00 110/104 R
1,993,901 A * 3/1935 Silley ..... F23D 1/00 431/188

(Continued)

FOREIGN PATENT DOCUMENTS

CL 3099-2007 5/2008
CL 2173-2008 A 11/2009

(Continued)

OTHER PUBLICATIONS

English Machine Translation: JP 10-332110. Accessed Aug. 14, 2014.*

(Continued)

*Primary Examiner* — Jianying C Atkisson
*Assistant Examiner* — Tavia Sullens
(74) *Attorney, Agent, or Firm* — Westerman, Hattori, Daniels & Adrian, LLP

(57) ABSTRACT

A solid-fuel-fired burner that suppresses a high-temperature oxygen remaining region formed at the outer circumference of a flame and that can decrease the amount of NOx eventually produced is provided. A solid-fuel-fired burner that is used in a burner section of a solid-fuel-fired boiler for performing low-NOx combustion separately in the burner section and in an additional-air injection section and that injects powdered solid-fuel and air into a furnace includes a fuel burner having internal flame stabilization and a second- (Continued)

ary-air injection port that does not perform flame stabilization, in which the air ratio in the fuel burner is set to 0.85 or more.

17 Claims, 18 Drawing Sheets

(58) Field of Classification Search
CPC ..... F23D 2201/10; F23D 2201/101; F23D 2201/20; F23D 2201/30; F23C 6/045; F23C 6/047; F23C 2201/20; F23C 2201/101; F23C 2201/00; F23C 2201/30; F23C 2201/301
USPC ..... 110/260, 188, 261, 297, 263, 265, 347, 110/348, 104 B, 104 R, 185, 186, 182.5; 431/8
See application file for complete search history.

(56) References Cited

U.S. PATENT DOCUMENTS

| | | | | |
|---|---|---|---|---|
| 2,608,168 | A | 8/1952 | Jackson | |
| 4,422,391 | A | 12/1983 | Izuha et al. | |
| 4,428,727 | A | 1/1984 | Deussner et al. | |
| 4,455,949 | A | 6/1984 | Kretschmer et al. | |
| 4,515,094 | A * | 5/1985 | Azuhata et al. | 110/347 |
| 4,520,739 | A * | 6/1985 | McCartney et al. | 110/263 |
| 4,545,307 | A * | 10/1985 | Morita et al. | 110/263 |
| 4,569,295 | A * | 2/1986 | Skoog | F23D 1/005 110/261 |
| 4,614,159 | A | 9/1986 | Sugiura et al. | |
| 4,634,054 | A * | 1/1987 | Grusha | F23D 1/00 239/423 |
| 4,653,998 | A * | 3/1987 | Sohma et al. | 110/186 |
| 4,988,286 | A | 1/1991 | Hersh | |
| 5,263,426 | A | 11/1993 | Morita et al. | |
| 5,315,939 | A * | 5/1994 | Rini et al. | 110/264 |
| 5,529,000 | A * | 6/1996 | Hartel et al. | 110/264 |
| 5,568,777 | A | 10/1996 | Breen et al. | |
| 5,662,464 | A * | 9/1997 | LaRose | F23C 7/02 110/265 |
| 5,829,367 | A | 11/1998 | Ohta et al. | |
| 5,979,342 | A | 11/1999 | Leisse et al. | |
| 6,152,051 | A | 11/2000 | Kiyama et al. | |
| 6,439,136 | B1 | 8/2002 | Mann et al. | |
| 6,497,230 | B1 * | 12/2002 | Higgins et al. | 110/163 |
| 6,715,432 | B2 * | 4/2004 | Tsumura et al. | 110/265 |
| 6,978,726 | B2 | 12/2005 | Kobayashi et al. | |
| 9,127,836 | B2 * | 9/2015 | Matsumoto | F23D 1/005 |
| 2002/0144636 | A1 | 10/2002 | Tsumura et al. | |
| 2005/0211142 | A1 | 9/2005 | Yamamoto et al. | |
| 2007/0026356 | A1 | 2/2007 | Okazaki et al. | |
| 2007/0234938 | A1 | 10/2007 | Briggs, Jr. et al. | |
| 2008/0206696 | A1 | 8/2008 | Wark | |
| 2009/0277364 | A1 * | 11/2009 | Donais | F23D 1/00 110/263 |
| 2010/0064986 | A1 * | 3/2010 | Kiyama | F23D 1/005 110/261 |

FOREIGN PATENT DOCUMENTS

| | | | | |
|---|---|---|---|---|
| CN | 1199453 | A | 11/1998 | |
| CN | 1243216 | A | 2/2000 | |
| CN | 1271826 | A | 11/2000 | |
| CN | 1386180 | A | 12/2002 | |
| CN | 1673620 | A | 9/2005 | |
| CN | 1246627 | C | 3/2006 | |
| CN | 102333991 | A | 1/2012 | |
| DE | 504814 | C | 8/1930 | |
| EP | 0 129 001 | A1 | 12/1984 | |
| EP | 0672863 | A2 | 9/1995 | |
| EP | 0 687 857 | A2 | 12/1995 | |
| EP | 1219893 | A1 * | 7/2002 | |
| GB | 316667 | A * | 5/1930 | F23D 1/00 |
| JP | 46-3549 | Y1 | 1/1971 | |
| JP | 56-44504 | A | 4/1981 | |
| JP | 59-124811 | U | 8/1984 | |
| JP | 60-4704 | A | 1/1985 | |
| JP | 60-057104 | A | 4/1985 | |
| JP | 60-78208 | A | 5/1985 | |
| JP | 60-103207 | A | 6/1985 | |
| JP | 60-162108 | A | 8/1985 | |
| JP | 60-171307 | A | 9/1985 | |
| JP | 60171307 | A * | 9/1985 | |
| JP | 62-909 | U | 1/1987 | |
| JP | 62-24209 | U | 2/1987 | |
| JP | 62-288406 | A | 12/1987 | |
| JP | 64-084005 | A | 3/1989 | |
| JP | 1-74409 | U | 5/1989 | |
| JP | 01-217109 | A | 8/1989 | |
| JP | 2-25086 | A | 1/1990 | |
| JP | 2-25086 | B2 | 5/1990 | |
| JP | 2-29368 | Y2 | 8/1990 | |
| JP | 4-116302 | A | 4/1992 | |
| JP | 4-115208 | U | 10/1992 | |
| JP | 07-260106 | A | 10/1995 | |
| JP | 8-135919 | A | 5/1996 | |
| JP | 8-200616 | A | 8/1996 | |
| JP | 8-219415 | A | 8/1996 | |
| JP | 8-296815 | A | 11/1996 | |
| JP | 9-101006 | A | 4/1997 | |
| JP | 9-203505 | A | 8/1997 | |
| JP | 10-38217 | A | 2/1998 | |
| JP | 2749365 | B2 | 5/1998 | |
| JP | 2781740 | B2 | 7/1998 | |
| JP | 10-220707 | A | 8/1998 | |
| JP | 10-318504 | A | 12/1998 | |
| JP | 10-332110 | A | 12/1998 | |
| JP | 2002-228107 | A | 8/2002 | |
| JP | 2002-533644 | A | 10/2002 | |
| JP | 2003-279006 | A | 10/2003 | |
| JP | 2005-24136 | A | 1/2005 | |
| JP | 3679998 | B2 | 8/2005 | |
| JP | 2005-265298 | A | 9/2005 | |
| JP | 2005-273973 | A | 10/2005 | |
| JP | 3716095 | B2 | 11/2005 | |
| JP | 2006-189188 | A | 7/2006 | |
| JP | 2008-180413 | A | 8/2008 | |
| JP | 2009-204256 | A | 9/2009 | |
| JP | 2010-270992 | A | 12/2010 | |
| TW | 313247 | | 8/1997 | |
| TW | 350905 | A | 1/1999 | |
| TW | 396261 | A | 7/2000 | |
| TW | M248974 | A | 11/2004 | |
| TW | 200907255 | A | 2/2009 | |
| TW | 200951374 | A | 12/2009 | |
| UA | 1090105 | A | 3/1982 | |
| WO | 02/012791 | A1 | 2/2002 | |
| WO | WO 2008038426 | A1 * | 4/2008 | F23D 1/005 |
| WO | 2009/114331 | A2 | 9/2009 | |

OTHER PUBLICATIONS

International Search Report of PCT/JP2010/059607, dated Aug. 17, 2010.
Japanese Office Action dated May 21, 2013, issued in corresponding Japanese Patent Application No. 2009-286663, w/ English translation.
Ukrainian Office Action dated Oct. 14, 2013, issued in Ukranian Patent Application No. a2012 00768, w/English translation.
Taiwanese Office Action dated Aug. 6, 2013, issued in corresponding Taiwanese Patent Application No. 099120296, w/English translation.
Korean Notice of Allowance dated Aug. 28, 2013, issued in corresponding Korean Patent Application No. 10-2012-7000361, w/English translation.
Extended European Search Report dated Sep. 12, 2013, issued in corresponding European Patent Application No. 10837312.7.
Chinese Office Action dated Aug. 21, 2013, issued in corresponding Chinese Patent Application No. 201080009471.9 w/English translation.

(56) References Cited

OTHER PUBLICATIONS

Japanese Office Action dated Feb. 4, 2014, issued in corresponding Japanese application No. 2013-151633, w/ English translation (13 pages).
Decision to grant a patent dated Aug. 12, 2014, issued in Japanese patent application No. 2013-151633 (3 pages).
Japanese Office Action dated Dec. 9, 2014, issued in corresponding JP Patent Application No. 2014-184838 with English translation (11 pages).
Office Action dated Feb. 4, 2015, issued in corresponding Chinese application No. 201310152762.9, with English Translation (11 pages).
Taiwanese Decision to Grant a Patent dated May 15, 2014, issued in corresponding Taiwanese Patent Application No. 099120296 (3 pages), The Decision to Grant a Patent has been received.
International Search Report of PCT/JP2010/054091, dated Apr. 27, 2010 (2 pages).
Concise explanation of relevance for Foreign Patent Document No. JP46-3549 (1 page).
Concise explanation of relevance for Foreign Patent Document No. JP60-162108 (1 page).
Concise explanation of relevance for Foreign Patent Document No. JP60-171307 (1 page).
English translation of Written Opinion of the International Searching Authority (Form PCT/IB/237) of International Application No. PCT/JP2010/054091 dated Apr. 27, 2010 (6 pages).
Taiwanese Office Action dated Apr. 8, 2013, issued in counterpart Taiwanese Patent Application No. 099123189, w/ English translation (6 pages).
Notice of Allowance dated Aug. 27, 2013, issued in counterpart Japanese Patent Application No. 2010-026882, w/ partial English translation (2 pages).
Japanese Office Action dated May 21, 2013, issued in counterpart Japanese Patent Application No. 2010-026882 with English translation (8 pages).
Chinese Office Action dated Feb. 12, 2014, issued in counterpart Chinese Patent Application No. 201080018542.1, w/English translation (21 pages).
Notice of Allowance dated Jun. 23, 2014, issued in counterpart Korean Patent Application No. 10-2013-7030282, w/ partial English translation (3 pages).
Ukrainian Office Action of Ukrainian Application No. 201200836 dated Dec. 9, 2013.
Extended European Search Report dated May 4, 2015, issued in counterpart European Patent Application No. 10839000.6 (6 pages).
Office Action dated Jun. 30, 2015, issued in counterpart Malaysian application No. PI 2012000294 (3 pages).
Office Action dated May 28, 2015, issued in counterpart Chinese Application No. 201310540955.1 w/English translation (18 pages).
Concise explanation of relevance for Foreign Patent Document No. JP62-288406 (1 page).
Non-Final Office Action dated Sep. 25, 2013, issued in U.S. Appl. No. 13/388,213 (21 pages).
Final Office Action dated Feb. 24, 2014, issued in U.S. Appl. No. 13/388,213 (12 pages).
Non-Final Office Action dated Sep. 8, 2014, issued in U.S. Appl. No. 13/388,213 (11 pages).
Final Office Action dated Dec. 31, 2014, issued in U.S. Appl. No. 13/388,213 (13 pages).
Decision of Rejection dated Mar. 31, 2015, issued in related Application No. 2014-184838, with English translation (10 pages).
Decision to Grant a Patent dated May 27, 2015, issued in counterpart Ukrainian Patent Application No. a 2013 14853 w/English translation (10 pages).
Decision to Grant a Patent dated Apr. 17, 2015, issued in counterpart Indonesian Patent Application No. W00201200155, Prevalent translation: "The Decision to Grant a Patent has been received." (2 pages).
Decision to Grant a Patent dated Jul. 28, 2015, issued in counterpart Japanese Patent Application No. 2014-184838, with English translation (8 pages).
Examiner's Report dated Dec. 4, 2014, issued in counterpart Chilean Patent Application No. 157-12, with English translation (30 pages).
Office Action dated Feb. 8, 2016, issued in European Patent Application No. 10839000.6. (7 pages).
Notification of Grant of Rights for Invention Patent dated Feb. 25, 2016, issued in counterpart Chinese Patent Application No. 201310152762.9, with English translation. (4 pages). Concise explanation of relevance: The Notification of Grant of Rights for Invention Patent has been received.
Decision to Grant a Patent dated Dec. 15, 2015, issued in counterpart Malaysian Patent Application No. PI2011006210 (3 pages).
Decision to Grant a Patent dated Dec. 17, 2015, issued in counterpart Chilean Application No. 2012-000157. (1 page).
Notification of Resolution of the Expert's Response dated Sep. 3, 2015, issued in counterpart Chilean Patent Application No. 2012-000251, w/English translation (14 pages).
Completion of Final Requirements dated Jun. 23, 2016, issued in counterpart Pilipino Patent Application No. 1-2012-500054. (2 pages). Concise Statement of Relevance: Completion of Final Requirements (Notice of Allowance) has been received.
Taiwanese Decision to Grant a Patent dated Sep. 22, 2015 issued in counterpart Taiwanese patent application No. 99123189. (5 pages) Concise English-language explanation of relevance: The Decision to Grant a Patent has been received.
Mexican Decision to Grant a Patent dated Sep. 25, 2015 issued in counterpart Mexican patent application No. MX/a2012/001169. (1 page) Concise English-language explanation of relevance: The Decision to Grant a Patent has been received.
Ukrainian Decision to Grant a Patent dated Oct. 21, 2015 issued in counterpart Ukrainian patent application No. a201200836. (4 pages) Concise English-language explanation of relevance: The Decision to Grant a Patent has been received.
Notice of Allowance dated Nov. 24, 2016, issued in counterpart Mexican Patent Application No. MX/a/2012/001164. (1 page). Explanation of Relevance: "The Notice of Allowance has been received".

* cited by examiner

OUTLET CIRCUMFERENTIAL LENGTH (L) = 2H+2W
IGNITION SURFACE LENGTH (Lf) = 6S

SOLID-FUEL-FIRED BURNER AND SOLID-FUEL-FIRED BOILER

TECHNICAL FIELD

The present invention relates to solid-fuel-fired burners and solid-fuel-fired boilers that combust solid fuel (powdered fuel) such as pulverized coal.

BACKGROUND ART

Examples of conventional solid-fuel-fired boilers include a pulverized-coal-fired boiler that combusts pulverized coal (coal) as solid fuel, for example. Examples of this pulverized-coal-fired boiler include two types of known combustion systems, i.e., a tangential firing boiler and a wall firing boiler.

Of those boilers, in the tangential firing boiler that combusts pulverized coal, secondary-air injection ports for injecting secondary air are disposed above and below primary air injected from a coal-fired burner (solid-fuel-fired burner) together with pulverized coal, serving as fuel, so as to perform airflow adjustment of secondary air around the coal-fired boiler (see Patent Literature 1, for example).

The amount of the above-described primary air needs to be sufficient to convey the pulverized coal, serving as fuel, and therefore, the amount thereof is specified in a roller mill for pulverizing coal to generate pulverized coal.

The above-described secondary air is blown at an amount required to form the entire flame in the tangential firing boiler. Therefore, the amount of secondary air for the tangential firing boiler is generally obtained by subtracting the amount of primary air from the total amount of air required for combustion of the pulverized coal.

On the other hand, in a burner of a wall firing boiler, it has been proposed that secondary air and tertiary air are introduced at an outer side of primary air (for supplying pulverized coal) to perform fine tuning of the amount of introduced air (see Patent Literature 2, for example).

CITATION LIST

Patent Literature

{PTL 1}
the Publication of Japanese Patent No. 3679998
{PTL 2}
Japanese Unexamined Patent Application, Publication No. 2006-189188

SUMMARY OF INVENTION

Technical Problem

The above-described conventional tangential firing boiler has a configuration in which one secondary-air injection port for injecting secondary air is provided above and below the coal-fired boiler, and thus, fine tuning of the amount of secondary air to be injected from the secondary-air injection ports cannot be performed. Therefore, a high-temperature oxygen remaining region is formed at the outer circumference of the flame, and in particular, the high-temperature oxygen remaining region is formed in a region where the secondary air is concentrated, to cause an increase in the amount of NOx produced, which is undesirable.

In general, the conventional coal-fired burner has a configuration in which a flame stabilizing mechanism (for tip-angle adjustment, turning, etc.) is disposed at the outer circumference of the burner, and further, secondary air (or tertiary air) injection ports are disposed immediately next to the outer circumference of the flame stabilizing mechanism. Therefore, ignition is brought about at the outer circumference of the flame, and a large amount of air is mixed at the outer circumference of the flame. As a result, combustion at the outer circumference of the flame progresses in a high-oxygen high-temperature state in the high-temperature oxygen remaining region at the outer circumference of the flame, and therefore, NOx is produced at the outer circumference of the flame.

Since the NOx thus produced in the high-temperature oxygen remaining region at the outer circumference of the flame passes through the outer circumference of the flame, the reduction of the NOx is delayed compared with that of NOx produced inside the flame, and this causes NOx to be produced from the coal-fired boiler.

On the other hand, also in the wall firing boiler, since ignition is performed at the outer circumference of the flame due to swirling, this similarly causes NOx to be produced at the outer circumference of the flame.

From those circumstances, as in the above-described conventional coal-fired burner and coal-fired boiler, in solid-fuel-fired burners and solid-fuel-fired boilers that combust powdered solid-fuel, it is desired to suppress a high-temperature oxygen remaining region formed at the outer circumference of the flame to reduce the amount of eventually produced NOx emitted from an additional-air injection section.

The present invention has been made in view of the above-described circumstances, and an object thereof is to provide a solid-fuel-fired burner and a solid-fuel-fired boiler capable of decreasing the amount of eventually produced NOx emitted from the additional-air injection section by suppressing (weakening) a high-temperature oxygen remaining region formed at the outer circumference of the flame.

Solution to Problem

In order to solve the above-described problems, the present invention employs the following solutions.

According to a first aspect, the present invention provides a solid-fuel-fired burner that is used in a burner section of a solid-fuel-fired boiler for performing low-NOx combustion separately in the burner section and in an additional-air injection section and that injects powdered solid-fuel and air into a furnace, including: a fuel burner having internal flame stabilization; and a secondary-air injection port that does not perform flame stabilization, in which an air ratio in the fuel burner is set to 0.85 or more.

According to this solid-fuel-fired burner of the first aspect of the present invention, since the fuel burner having the internal flame stabilization and the secondary-air injection port that does not perform flame stabilization are provided, and the air ratio in the fuel burner is set to 0.85 or more, the amount of air in an additional-air injection section (the amount of injected additional air) is decreased compared with a case in which the air ratio is set to 0.8, for example. As a result, the additional-air injection section where the amount of injected additional air is decreased, the amount of NOx eventually produced is decreased.

The above-described decrease in the amount of injected additional air is enabled when ignition in the fuel burner is enhanced with the internal flame stabilization by employing the fuel burner having the internal flame stabilization and the secondary-air injection port that does not perform flame stabilization, and when the diffusion of air into the inside of the flame is improved to suppress an oxygen remaining region formed in the flame. Specifically, since a high-temperature oxygen remaining region formed at the outer circumference of the flame is suppressed, and furthermore, the enhancement of ignition produces NOx inside the flame to effectively reduce the NOx, the amount of NOx reaching the additional-air injection section is decreased. Further, since the amount of injected additional air is decreased in the additional-air injection section, the amount of NOx produced in the additional-air injection section is also decreased, and, as a result, the amount of NOx eventually emitted can be decreased.

Further, the adoption of the secondary-air injection port that does not perform flame stabilization is also effective to decrease the amount of NOx produced at the outer circumference of the flame.

In the above-described solid-fuel-fired burner, a more preferable air ratio in the fuel burner is 0.9 or more.

In the solid-fuel-fired burner according to the first aspect of the present invention, it is preferable that the fuel burner injects powdered fuel and air into the furnace; the secondary-air injection port is disposed above and below and/or on the right and left sides of the fuel burner and has an airflow adjustment means; and one or more splitting members is arranged at a flow-path front part of the fuel burner.

According to this solid-fuel-fired burner, since the solid-fuel-fired burner, which injects powdered fuel and air into the furnace, is provided with one or more splitting members arranged at the flow-path front part of the fuel burner, the splitting members function as an internal flame stabilizing mechanism near the center of the outlet opening of the fuel burner. Since internal flame stabilization is enabled by the splitting members, the center portion of the flame becomes deficient in air, and thereby NOx reduction proceeds.

In the solid-fuel-fired burner according to the first aspect of the present invention, it is preferable that the fuel burner injects powdered fuel and air into the furnace; the secondary-air injection port is disposed above and below and/or on the right and left sides of the fuel burner and has an airflow adjustment means; and splitting members are arranged in a plurality of directions at a flow-path front part of the fuel burner.

According to this solid-fuel-fired burner, since the solid-fuel-fired burner, which injects powdered fuel and air into the furnace, is provided with the splitting members arranged in a plurality of directions at the flow-path front part of the fuel burner, crossing parts of the splitting members, functioning as the internal flame stabilizing mechanism, can be easily provided near the center of the outlet opening of the fuel burner.

Therefore, in the vicinity of the center of the outlet opening of the fuel burner where the splitting members cross, the flow of powdered fuel and air is disturbed by the presence of the splitting members that divide the flow path. As a result, air mixing and diffusion are facilitated even inside the flame, and further, the ignition area is divided, thereby making the ignition position come close to the center portion of the flame and decreasing the amount of unburned fuel. Specifically, since it becomes easy for oxygen to come into the center portion of the flame along the splitting members, the high-temperature oxygen remaining region at the outer circumference of the flame is suppressed, thereby effectively performing internal ignition. When ignition in the flame is facilitated as described above, reduction rapidly proceeds in the flame, thus decreasing the amount of NOx produced, compared with a case where ignition is performed in the high-temperature oxygen remaining region at the outer circumference of the flame.

Note that, in this solid-fuel-fired burner, it is preferable that a flame stabilizer that is conventionally disposed at the outer circumference of the burner be eliminated, thereby further suppressing the amount of NOx produced at the outer circumference of the flame.

In the solid-fuel-fired burner according to the first aspect of the present invention, it is preferable that an ignition surface length (Lf) constituted by the splitting members be set larger than an outlet-opening circumferential length (L) of the fuel burner (Lf>L).

When the length of the splitting members is set as described above, the ignition surface determined by the ignition surface length (Lf) is larger than that used in ignition performed at the outer circumference of the flame. Therefore, compared with the ignition performed at the outer circumference of the flame, internal ignition is enhanced, thereby facilitating rapid reduction in the flame.

Further, since the splitting members divide the flame therein, rapid combustion in the flame is enabled.

In the above-described solid-fuel-fired burner, it is preferable that the splitting members be disposed densely at the center of an outlet opening of the fuel burner.

When the splitting members, serving as the internal flame stabilizing mechanism, are disposed densely at the center of the outlet opening, as described above, the splitting members are concentrated at the center portion of the fuel burner, thereby further facilitating ignition at the center portion of the flame to produce and rapidly reduce NOx in the flame.

Further, when the splitting members are arranged densely at the center, the unoccupied area in the central part of the fuel burner is decreased, thereby relatively increasing the pressure loss at the splitting members. Therefore, the flow velocity of powdered fuel and air flowing in the fuel burner is decreased, and more rapid ignition can be brought about.

In the above-described solid-fuel-fired burner, it is preferable that the secondary-air injection ports be each divided into a plurality of independent flow paths each having airflow adjustment means.

The thus-configured solid-fuel-fired burner can perform flow-rate distribution such that the amount of secondary air to be injected into the outer circumference of the flame is set to a desired value by operating the airflow adjustment means for each of the divided flow paths. Therefore, when the amount of secondary air to be injected into the outer circumference of the flame is properly set, formation of a high-temperature oxygen remaining region can be suppressed or prevented.

In the solid-fuel-fired burner according to the first aspect of the present invention, it is preferable that the fuel burner injects powdered fuel and air into the furnace; the secondary-air injection port is disposed above and below and/or on the right and left sides of the fuel burner and divided into a plurality of independent flow paths each having an airflow adjustment means; and a splitting member is arranged at a flow-path front part of the fuel burner.

According to this solid-fuel-fired burner, the fuel burner that injects powdered fuel and air into the furnace; the secondary-air injection ports that are each disposed above and below and/or on the right and left sides of the fuel burner and that each have airflow adjustment means, the secondary-air injection ports each being divided into a plurality of independent flow paths each having the airflow adjustment means; and the splitting member arranged at the flow-path front part of the fuel burner are further provided. Therefore, flow-rate distribution can be performed such that the amount of secondary air to be injected into the outer circumference of the flame is set to a desired value by operating the airflow adjustment means for each of the divided flow paths. Therefore, when the amount of secondary air to be injected into the outer circumference of the flame is properly set, formation of a high-temperature oxygen remaining region can be suppressed or prevented.

Further, when the splitting member is provided at the flow-path front part of the fuel burner, it is possible to disturb the flow of powdered fuel and air to bring about ignition in the flame. As a result, NOx is produced in the flame and is rapidly reduced in the flame, which is deficient in air, because the produced NOx contains many types of hydrocarbons having a reducing action. In other words, the splitting member can enhance internal flame stabilization to prevent or suppress the formation of a high-temperature oxygen remaining region.

Therefore, in this solid-fuel-fired burner, it is preferable that a flame stabilizer that is conventionally disposed at the outer circumference of the burner be eliminated.

In the above-described solid-fuel-fired burner, it is preferable to further include a flow adjustment mechanism that applies a pressure loss to a flow of the powdered fuel and air provided at an up stream side of the splitting members.

Since this flow adjustment mechanism eliminates flow rate deviation of powdered fuel caused by passing through a vent provided in a flow path, it is possible to effectively utilize the internal flame stabilizing mechanism constituted by the splitting members.

In the above-described solid-fuel-fired burner, it is preferable that the secondary-air injection ports be each provided with an angle adjustment mechanism.

When the secondary-air injection ports are each provided with the angle adjustment mechanism, it is possible to optimally supply secondary air from the secondary-air injection ports farther outward of the flame. Further, since swirling is not utilized, it is possible to prevent or suppress formation of a high-temperature oxygen remaining region while preventing excessive spreading of the flame.

In the above-described solid-fuel-fired burner, it is preferable that distribution of the amount of air to be injected from the secondary-air injection ports be feedback-controlled based on the amount of unburned fuel and the amount of nitrogen oxide (NOx) emission.

When this feedback control is performed, the distribution of secondary air can be automatically optimized. In this control, for example, when the amount of unburned fuel is high, the distribution of secondary air to an inner side close to the outer circumferential surface of the flame is increased; and, when the amount of nitrogen oxide emission is high, the distribution of secondary air to an outer side far from the outer circumferential surface of the flame is increased.

Note that, to measure the amount of unburned fuel, collected ash may be analyzed each time, for example, or an instrument for measuring the carbon concentration from scattering of laser light may be employed.

In the above-described solid-fuel-fired burner, it is preferable that the amount of air to be injected from the secondary-air injection ports be distributed among multi-stage air injections that make a region from the burner section to the additional-air injection section a reducing atmosphere.

When the amount of air is distributed in this way, the amount of nitrogen oxide produced can be further decreased due to the synergy between a decrease in nitrogen oxide through suppression of the high-temperature oxygen remaining region formed at the outer circumference of the flame and a decrease in nitrogen oxide in combustion exhaust gas, caused by providing the reducing atmosphere.

In the above-described solid-fuel-fired burner, it is preferable that a system for supplying air to a coal secondary port of the fuel burner be separated from a system for supplying air to the secondary-air injection ports.

When those air supply systems are provided, the amount of air can be reliably adjusted even when the secondary-air injection ports are each divided into a plurality of ports to provide multiple stages.

In the above-described solid-fuel-fired burner, it is preferable that the plurality of flow paths of the secondary-air injection ports be concentrically provided around the fuel burner, which has a circular shape, in an outer circumferential direction in a multi-stage fashion.

The thus-configured solid-fuel-fired burner can be applied particularly to a wall firing boiler. Since air is uniformly introduced from its circumference, the high-temperature high-oxygen region can be more precisely decreased.

According to a second aspect, the present invention provides a solid-fuel-fired boiler in which the above-described solid-fuel-fired burner that injects powdered fuel and air into a furnace is disposed at a corner or on a wall of the furnace.

According to the solid-fuel-fired boiler of the second aspect of the present invention, since the above-described solid-fuel-fired burner, which injects powdered fuel and air into the furnace, is provided, splitting members that are disposed near the center of the outlet opening of a fuel burner and that function as an internal flame stabilizing mechanism divide the flow path of powdered fuel and air to disturb the flow thereof. As a result, air mixing and diffusion are facilitated even in the flame, and, further, the ignition surface is divided, thereby making the ignition position close to the center of the flame, decreasing the amount of unburned fuel. Specifically, since it becomes easy for oxygen to come into the center portion of the flame, internal ignition is effectively performed, and therefore, rapid reduction proceeds in the flame, decreasing the amount of NOx emission.

According to a third aspect, the present invention provides an operation method of a solid-fuel-fired burner that is used in a burner section of a solid-fuel-fired boiler for performing low-NOx combustion separately in the burner section and in an additional-air injection section and that injects powdered solid-fuel and air into a furnace, the solid-fuel-fired burner including: a fuel burner having internal flame stabilization; and a secondary-air injection port that does not perform flame stabilization, in which operation is performed with an air ratio in the fuel burner set to 0.85 or more.

According to this operation method of a solid-fuel-fired burner, the solid-fuel-fired burner includes the fuel burner having the internal flame stabilization and the secondary-air injection port that does not perform flame stabilization and is operated with the air ratio in the fuel burner set to 0.85 or more. Therefore, the amount of air (the amount of injected additional air) in the additional-air injection section is decreased compared with a case in which the air ratio is 0.8, for example. As a result, in the additional-air injection section where the amount of injected additional air is decreased, the amount of NOx eventually produced is decreased.

Advantageous Effects of Invention

According to the above-described solid-fuel-fired burner and solid-fuel-fired boiler of the present invention, since the fuel burner having the internal flame stabilization and the secondary-air injection port that does not perform flame stabilization are provided, and the air ratio in the fuel burner is set to 0.85 or more, preferably, to 0.9 or more, a decrease in the amount of injected additional air decreases the amount of NOx produced in the additional-air injection section.

Further, since the high-temperature oxygen remaining region formed at the outer circumference of the flame is suppressed, and NOx produced in the flame, in which combustion approaching premix combustion is achieved, is effectively reduced, a decrease in the amount of NOx reaching the additional-air injection section and a decrease in the amount of NOx produced due to the injection of additional air decrease the amount of NOx eventually emitted from the additional-air injection section.

Further, since the splitting members arranged in a plurality of directions that function as the internal flame stabilizing mechanism are provided at the outlet opening of the fuel burner, the flow path of powdered fuel and air is divided to disturb the flow thereof in the vicinity of the center of the outlet opening of the fuel burner where the splitting members cross. As a result, since air mixing and diffusion is facilitated even in the flame, and further, the splitting members divide the ignition surface, the ignition position comes close to the center of the flame, and the amount of unburned fuel is decreased. This is because it becomes easy for oxygen to come into the center portion of the flame, and internal ignition is effectively performed with this oxygen, and thereby rapid reduction proceeds in the flame, decreasing the amount of produced NOx eventually emitted from the solid-fuel-fired boiler.

Furthermore, by adjusting injection of secondary air, concentration of secondary air at the outer circumference of the flame can be prevented or suppressed. As a result, it is possible to suppress the high-temperature oxygen remaining region formed at the outer circumference of the flame, decreasing the amount of nitrogen oxide (NOx) produced.

Further, by using an operation method of a solid-fuel-fired burner in which the burner is operated with the air ratio in the fuel burner set to 0.85 or more, the amount of air (the amount of injected additional air) in the additional-air injection section can be decreased, thereby decreasing the amount of NOx eventually produced in the additional-air injection section where the amount of injected additional air is decreased.

DESCRIPTION OF EMBODIMENTS

A solid-fuel-fired burner and a solid-fuel-fired boiler according to one embodiment of the present invention will be described below based on the drawings. Note that, in this embodiment, as one example of the solid-fuel-fired burner and the solid-fuel-fired boiler, a tangential firing boiler provided with solid-fuel-fired burners that use pulverized coal (powdered solid-fuel coal) as fuel will be described, but the present invention is not limited thereto.

Figure 3:
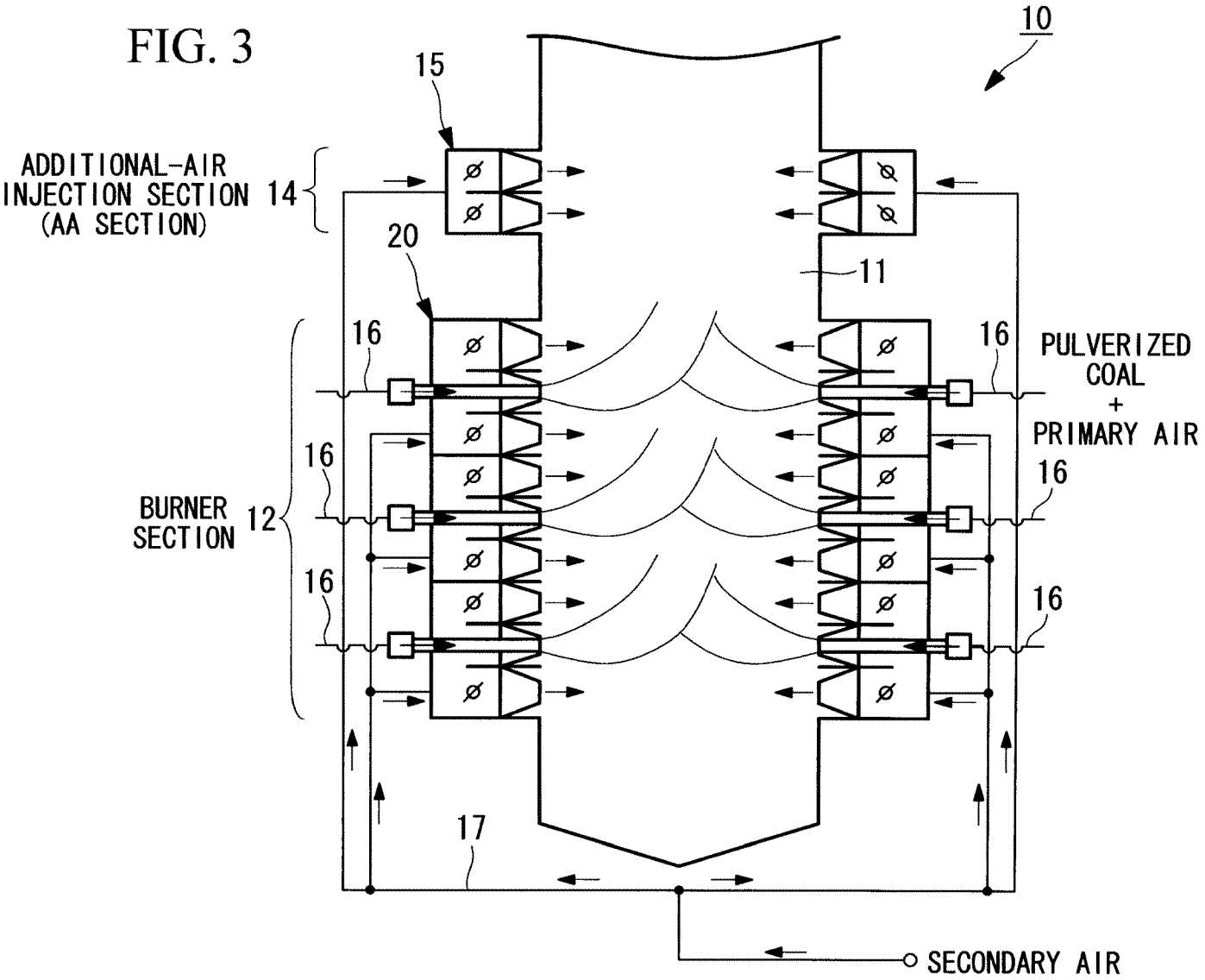
FIG. 3 is a vertical cross-sectional view showing a configuration example of a solid-fuel-fired boiler (coal-fired boiler) according to the present invention.
Figure 4:
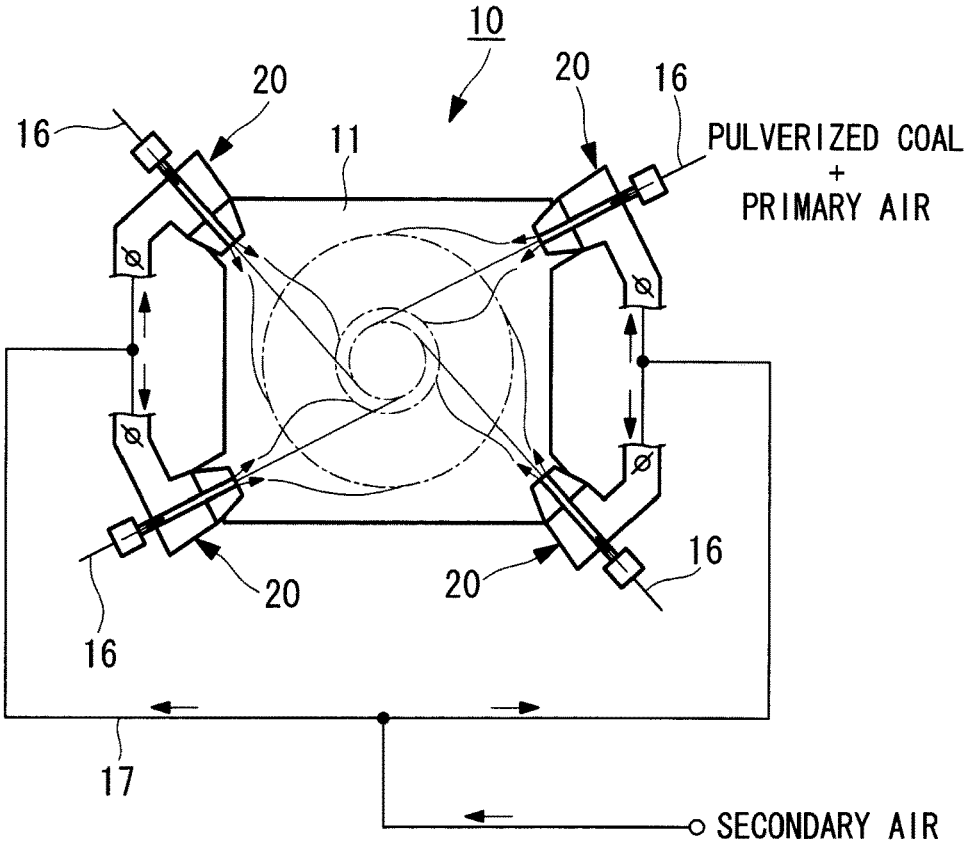
FIG. 4 is a (horizontal) cross-sectional view of FIG. 3.
Figure 5:
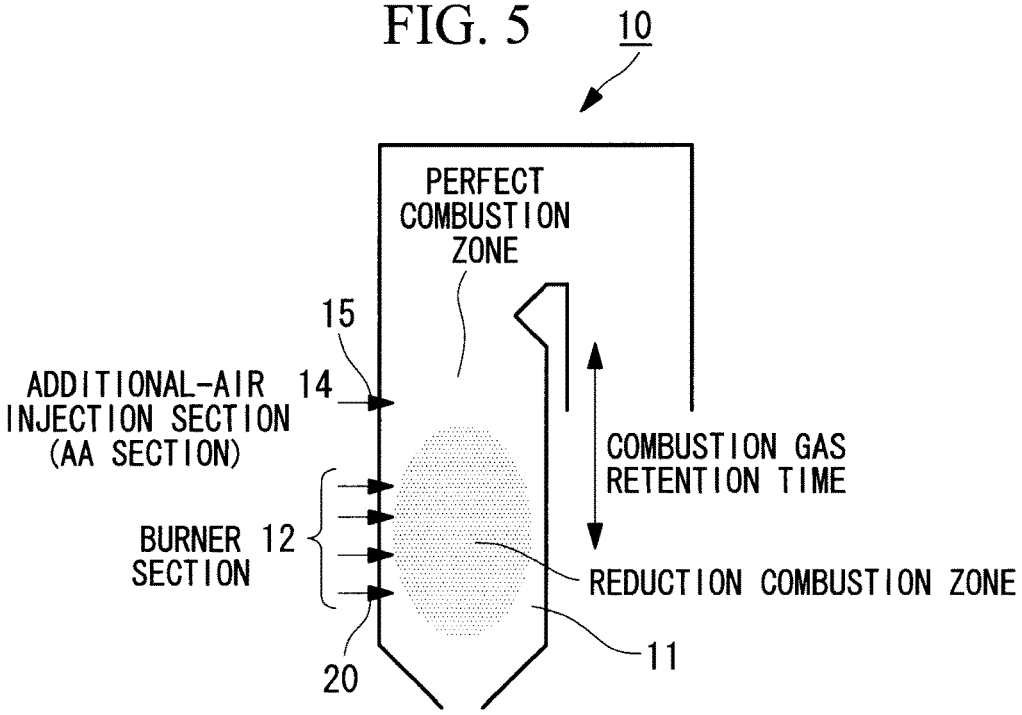
FIG. 5 is an explanatory diagram showing, in outline, the solid-fuel-fired boiler that is provided with an additional-air injection section and in which air is injected in a multi-stage fashion.

A tangential firing boiler 10 shown in FIGS. 3 to 5 injects air into a furnace 11 in a multi-stage fashion to make a region from a burner section 12 to an additional-air injection section (hereinafter, referred to as "AA section") 14 a reducing atmosphere, thereby achieving a decrease in NOx in combustion exhaust gas.

In the drawings, reference numeral 20 denotes solid-fuel-fired burners that inject pulverized coal (powdered solid-fuel) and air, and reference numeral 15 denotes additional-air injection nozzles that inject additional air. For example, as shown in FIG. 3, pulverized-coal mixed air conveying pipes 16 that convey pulverized coal by primary air and an air supply duct 17 that supplies secondary air are connected to the solid-fuel-fired burners 20, and the air supply duct 17, which supplies secondary air, is connected to the additional-air injection nozzles 15.

In this way, the above-described tangential firing boiler 10 employs a tangential firing system in which the solid-fuel-fired burners 20, which inject pulverized coal (coal), serving as powdered fuel, and air into the furnace 11, are disposed at respective corner portions at each stage to constitute the tangential-firing-type burner section 12, and one or more swirling flames are formed in each stage.

First Embodiment

Figure 1A:
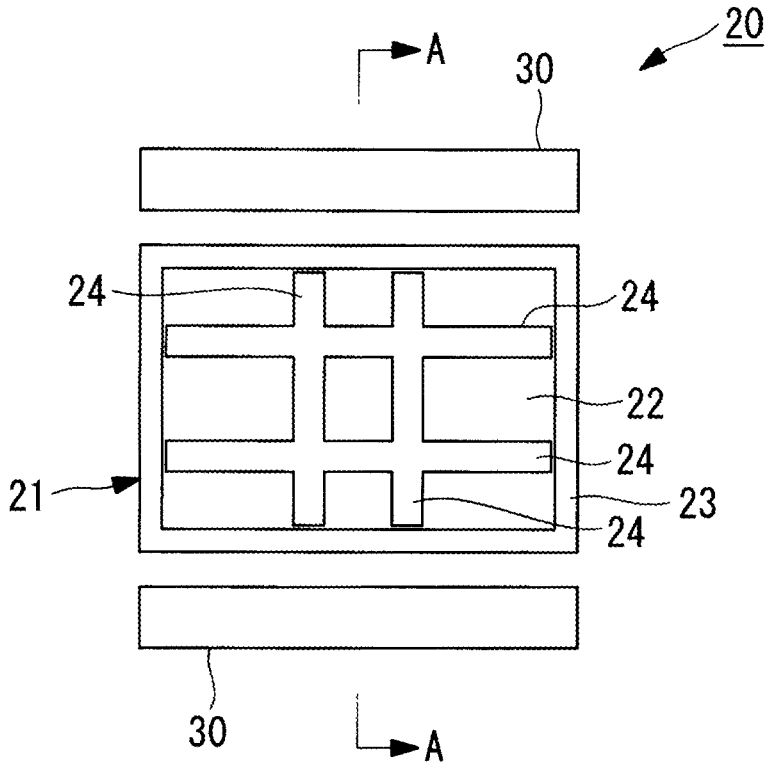
FIG. 1A is a front view of a solid-fuel-fired burner (coal-fired burner) according to a first embodiment of the present invention, when the solid-fuel-fired burner is seen from the inside of a furnace.
Figure 1B:
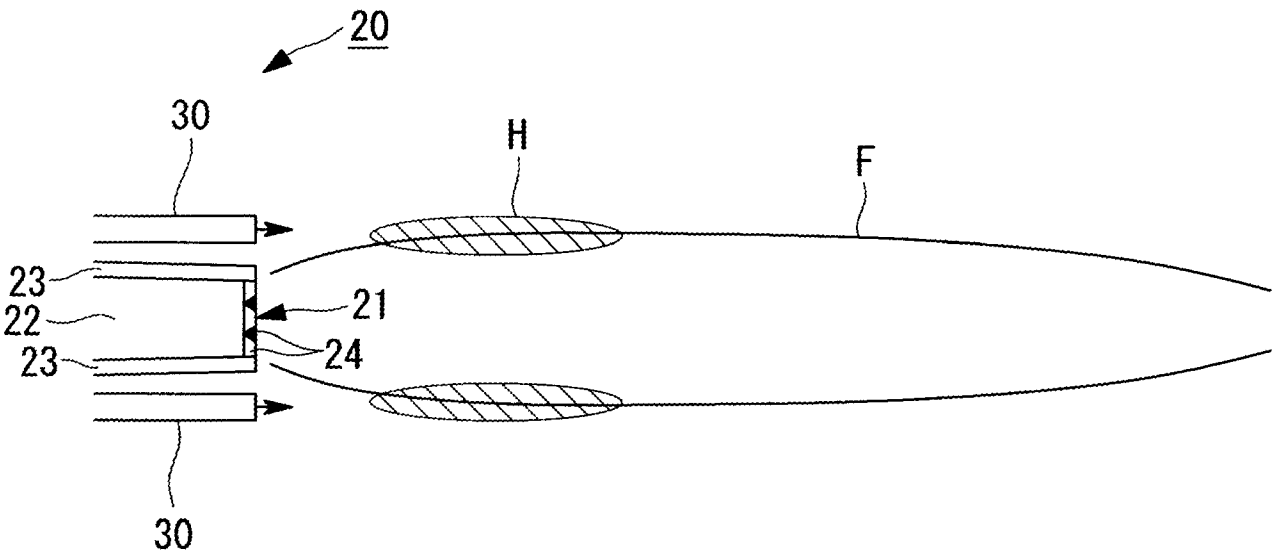
FIG. 1B is a cross-sectional view of the solid-fuel-fired burner (vertical cross-sectional view thereof) along arrows A-A shown in FIG. 1A.

The solid-fuel-fired burner 20 shown in FIGS. 1A and 1B includes a pulverized-coal burner (fuel burner) 21 that injects pulverized coal and air and secondary-air injection ports 30 that are disposed above and below the pulverized-coal burner 21.

Figure 2:
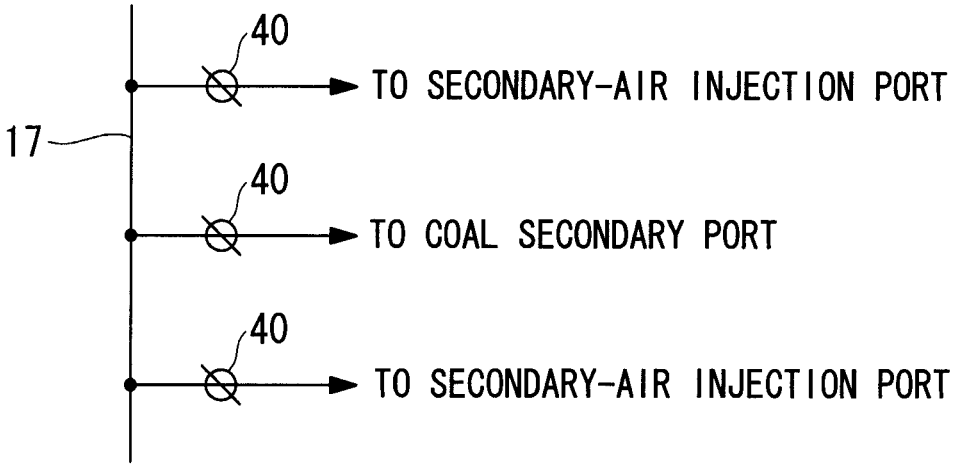
FIG. 2 is a diagram showing an air supply system for supplying air to the solid-fuel-fired burner shown in FIGS. 1A and 1B.

In order to allow airflow adjustment in each port, the secondary-air injection ports 30 are provided with dampers 40 that can adjust the degrees of opening thereof, as airflow adjustment means, in each secondary-air supply line branched from the air supply duct 17, as shown in FIG. 2, for example.

The above-described pulverized-coal burner 21 includes a rectangular coal primary port 22 that injects pulverized coal conveyed by primary air and a coal secondary port 23 (a secondary port) that is provided so as to surround the coal primary port 22 and that injects part of secondary air. Note that the coal secondary port is a port that is connected to the air supply duct as shown in FIG. 2. The coal secondary port receives a portion of the secondary air flowing through the air supply duct 17 and injects the received portion of the secondary air to the furnace as shown in FIG. 3. Note that the coal secondary port 23 is also provided with a damper 40 that can adjust the degree of opening thereof, as airflow adjustment means, as shown in FIG. 2. Note that the coal primary port 22 may have a circular shape or an elliptical shape.

At a flow-path front part of the pulverized-coal burner 21, specifically, at a flow-path front part of the coal primary port 22, splitting members 24 are arranged in a plurality of directions. For example, as shown in FIG. 1A, a total of four splitting members 24 are arranged, two vertically and two horizontally, in a grid-like pattern with a predetermined gap therebetween at an outlet opening of the coal primary port 22.

In other words, the four splitting members 24 are arranged in two different directions, that is, the vertical and horizontal directions, in a grid-like pattern, thereby dividing the outlet opening of the coal primary port 22 of the pulverized-coal burner 21 into nine portions.

When the above-described splitting members 24 employ the cross-sectional shapes shown in FIGS. 6A to 6D, for example, the flow of pulverized coal and air can be smoothly split and disturbed.

Figure 6A:
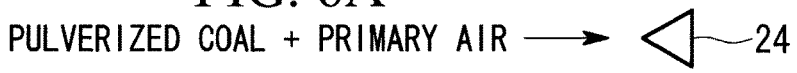
FIG. 6A is a view showing one example of the cross-sectional shape of a splitting member in the solid-fuel-fired burner shown in FIGS. 1A and 1B.

The splitting member 24 shown in FIG. 6A has a triangular shape in cross section. The triangular shape shown in the figure is an equilateral triangle or an isosceles triangle, and a side thereof positioned at the outlet facing the inside of the furnace 11 is located so as to be approximately perpendicular to the flow direction of pulverized coal and air. In other words, one of the angles constituting the triangular shape in cross section faces the flow direction of pulverized coal and air.

Figure 6B:
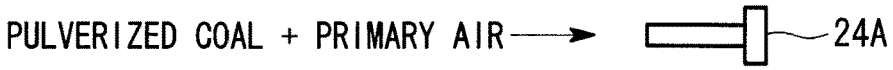
FIG. 6B is a view showing a first modification of the cross-sectional shape shown in FIG. 6A.
Figure 6C:
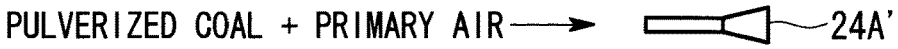
FIG. 6C is a view showing a second modification of the cross-sectional shape shown in FIG. 6A.

A splitting member 24A shown in FIG. 6B has an approximately T-shape in cross section, and a surface thereof that is approximately perpendicular to the flow direction of pulverized coal and air is located at the outlet facing the inside of the furnace 11. Note that this approximately T-shape in cross section may be deformed to form a splitting member 24A' having a trapezoidal shape in cross section, as shown in FIG. 6C, for example.

Figure 6D:
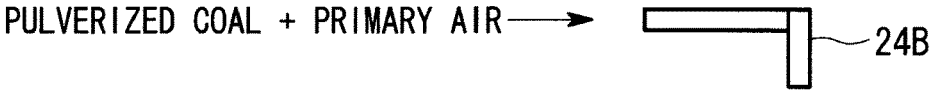
FIG. 6D is a view showing a third modification of the cross-sectional shape shown in FIG. 6A.

Further, a splitting member 24B shown in FIG. 6D has an approximately L-shape in cross section. Specifically, it has a shape in cross section obtained by cutting off a part of the above-described approximately T-shape. In particular, in a case where the splitting member 24B is disposed in a right-and-left (horizontal) direction, if the splitting member 24B has an approximately L-shape obtained by removing an upper protruding portion of the above-described approximately T-shape, it is possible to prevent pulverized coal from being accumulated on the splitting member 24B. Note that, when a lower protruding portion thereof is enlarged by an amount equal to the removed upper protruding portion, the required splitting performance for the splitting member 24B can be ensured.

However, the above-described cross-sectional shapes of the splitting members 24 etc. are not limited to the examples shown in the figures; they may be an approximately Y-shape, for example.

In the thus-configured solid-fuel-fired burner 20, the splitting members 24 disposed near the center of the outlet opening of the pulverized-coal burner 21 split the flow path of pulverized coal and air to disturb the flow therein, forming a recirculation region in front of the splitting members 24, thereby serving as an internal flame stabilizing mechanism.

In general, in a conventional solid-fuel-fired burner, pulverized coal, serving as fuel, is ignited upon receiving radiation at the outer circumference of the flame. When the pulverized coal is ignited at the outer circumference of the flame, NOx is produced in a high-temperature oxygen remaining region H (see FIG. 1B) at the outer circumference of the flame where high-temperature oxygen remains, and remains insufficiently reduced, thus increasing the amount of NOx emission.

However, since the splitting members 24 serving as the internal flame stabilizing mechanism are provided, the pulverized coal is ignited in the flame. Thus, NOx is produced in the flame and is rapidly reduced in the flame, which is deficient in air, because the NOx produced in the flame contains many types of hydrocarbons having a reducing action. Therefore, since the solid-fuel-fired burner 20 is structured such that flame stabilization realized by disposing a flame stabilizer at the outer circumference of flame is not employed, in other words, such that a flame stabilizing mechanism is not disposed at the outer circumference of the burner, it is also possible to suppress the production of NOx at the outer circumference of the flame.

In particular, since the splitting members 24 are arranged in a plurality of directions, crossing parts at which the splitting members 24 arranged in the different directions cross are easily provided near the center of the outlet opening of the pulverized-coal burner 21. When such crossing parts are provided near the center of the outlet opening of the pulverized-coal burner 21, the flow path of pulverized coal and air is split into a plurality of paths near the center of the outlet opening of the pulverized-coal burner 21, thereby disturbing the flow thereof when the flow is split into a plurality of flows.

Specifically, if the splitting members 24 are arranged in one horizontal direction, air diffusion and ignition at a center portion are delayed, causing an increase in the amount of unburned fuel; however, if the splitting members 24 are arranged in a plurality of directions to form the crossing parts, mixing of air is facilitated, and the ignition surface is divided, thereby making it easy for air (oxygen) to come into the center portion of flame, resulting in a decrease in the amount of unburned fuel.

In other words, when the splitting members 24 are arranged so as to form the crossing parts, mixing and diffusion of air are facilitated even inside the flame, and further, the ignition surface is divided, thereby making the ignition position come close to the center portion (axial center portion) of the flame and decreasing the amount of unburned pulverized coal. Specifically, since it becomes easy for oxygen to come into the center portion of flame, internal ignition is effectively performed, and thus, rapid reduction proceeds in the flame, decreasing the amount of NOx produced.

As a result, it becomes easier to suppress the production of NOx at the outer circumference of the flame by using the solid-fuel-fired burner 20 that does not employ flame stabilization realized by a flame stabilizer disposed at the outer circumference of the flame and that has no flame stabilizer at the outer circumference of the flame.

Figure 7A:
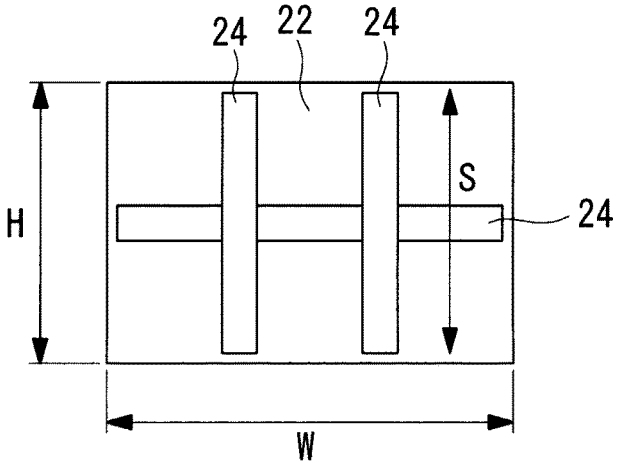
FIG. 7A is a front view showing a first modification of a coal primary port of the solid-fuel-fired burner, shown in FIGS. 1A and 1B, where the arrangement of splitting members as shown in FIG. 7A is different than the arrangement of splitting members as shown in FIG. 1A.

Next, a first modification of the coal primary port 22 of the solid-fuel-fired burner 20, shown in FIG. 1A, will be described based on FIGS. 7A and 7B, in which the arrangement of the splitting members 24 is different.

In this modification, at the flow-path front part of the coal primary port 22, two splitting members 24 are arranged in the vertical direction of the outlet opening thereof, and one splitting member 24 is arranged in the horizontal direction of the outlet opening thereof.

The splitting members 24 shown in the figures are structured such that an ignition surface length (Lf) constituted by the splitting members 24 is larger than an outlet-opening circumferential length (L) of the coal primary port 22 that constitutes the pulverized-coal burner 21 (Lf>L).

Here, since the outlet-opening circumferential length (L) of the coal primary port 22 is the sum of the lengths of four sides constituting the rectangle, it is expressed by L=2H+2W, where H indicates the vertical dimension, and W indicates the horizontal dimension.

On the other hand, since each splitting member 24, which has a certain width, has ignition surfaces on both sides thereof, the ignition surface length (Lf) of the splitting members 24, which is the total length of both sides of each of the three splitting members 24, is expressed by Lf=6S, where S indicates the length of the splitting member 24. In this case, since the length of the short splitting member 24 that is arranged in the vertical direction is used as the length S, the calculated ignition surface length (Lf) is an estimated value erring on the safe side even if the presence of the crossing parts is taken into account.

Figure 7B:
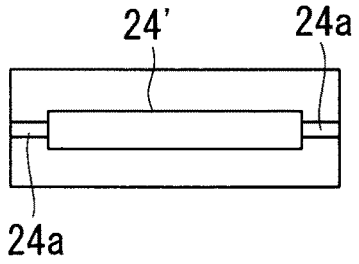
FIG. 7B shows a splitting member having narrow parts at both ends as being part of an ignition surface length (Lf) of the coal primary port of the solid-fuel-fired burner shown in FIGS. 1A and 1B.

Note that, when calculating the ignition surface length (Lf), if a splitting member 24' that is structured to have narrow parts 24*a* at both ends due to a splitting-member manufacturing method or the like is used, as shown in FIG. 7B, for example, the narrow parts 24*a* at both ends are also considered as part of the ignition surface.

When the length of the splitting member 24 is specified as described above, the ignition surface determined by the ignition surface length (Lf) is larger than that used in ignition performed at the outer circumference of the flame. Therefore, compared with the ignition performed at the outer circumference of the flame determined by the outlet-opening circumferential length (L), internal ignition determined by the ignition surface length (Lf) is enhanced, thereby allowing rapid reduction of NOx produced in the flame.

Further, since the splitting members 24 divide the flame therein, it becomes easy for air (oxygen) to come into the center portion of the flame, and thus, rapid combustion in the flame can decrease the amount of unburned fuel.

Figure 8:
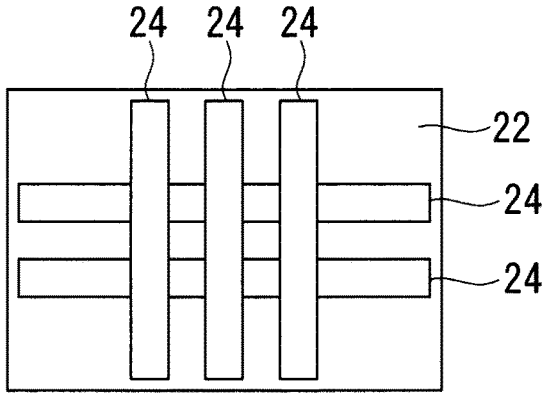
FIG. 8 is a front view showing a second modification of the coal primary port of the solid-fuel-fired burner shown in FIGS. 1A and 1B, in which the arrangement of the splitting members is different.

Next, a second modification of the coal primary port 22 of the solid-fuel-fired burner 20, shown in FIG. 1A, will be described based on FIG. 8, in which the arrangement of the splitting members 24 is different.

In this modification, five splitting members 24 are disposed in a grid-like pattern densely at the center of the outlet opening of the coal primary port 22 of the fuel burner 21. Specifically, the splitting members 24, three of which are arranged in the vertical direction and two of which are arranged in the horizontal direction, are disposed with the gaps therebetween being narrowed at the center of the coal primary port 22. Therefore, center portions of the outlet opening of the coal primary port 22, divided by the splitting members 24, have areas smaller than other portions at the outer circumferential side thereof.

In this way, when the splitting members 24, serving as the internal flame stabilizing mechanism, are arranged densely at the center of the coal primary port 22, the splitting members 24 are concentrated at the center portion of the pulverized-coal burner 21, thereby further facilitating ignition at the center portion of the flame to rapidly produce and reduce NOx in the flame.

Further, when the splitting members 24 are arranged densely at the center, the unoccupied area in the central part of the pulverized-coal burner 21 is decreased. Specifically, since the ratio of pulverized coal and air passing through the cross-sectional area of a flow path that is almost straight without any obstacle with respect to those flowing in the coal primary port 22 of the pulverized-coal burner 21 is decreased, the pressure loss at the splitting members 24 is relatively increased. Therefore, in the fuel burner 21, since the flow velocity of pulverized coal and air flowing in the coal primary port 22 is decreased under the influence of an increase in the pressure loss, more rapid ignition can be brought about.

Figure 9:
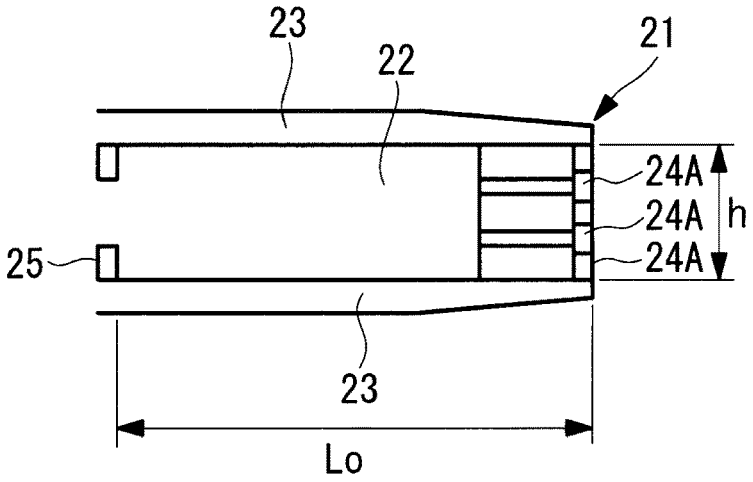
FIG. 9 is a vertical cross-sectional view showing a configuration example in which a flow adjustment mechanism is provided at a burner base, as a third modification of the solid-fuel-fired burner of the first embodiment.

Next, a configuration example according to a third modification of the coal primary port 22 of the solid-fuel-fired burner 20, shown in FIG. 1A, will be described based on FIG. 9, in which a flow adjustment mechanism is provided at a burner base. Note that the configuration example shown in the figure employs the splitting members 24A having an approximately T-shape in cross section, but the shape thereof is not limited thereto.

In this configuration example, in order to apply the pressure loss to a flow of pulverized coal and air, a flow adjustment mechanism 25 is provided at an upstream side of the splitting members 24A. The flow adjustment mechanism 25 prevents flow rate deviation in a port cross-section direction, and it is effective to dispose an orifice or a venturi that can restrict the flow-path cross-sectional area to approximately ⅔, preferably, to approximately ½, for example.

The flow adjustment mechanism 25 may have any structure so long as it can apply a certain pressure loss to a powder transfer flow that conveys pulverized coal, serving as fuel, by primary air, and therefore, the flow adjustment mechanism 25 is not limited to an orifice.

Further, the above-described flow adjustment mechanism 25 is not necessarily formed as a part of the solid-fuel-fired burner 20 and just needs to be disposed, at the upstream side of the splitting member 24A, in a final straight pipe portion (straight flow-path portion without a vent, a damper, etc.) in the flow path in which pulverized coal and primary air flow.

When the flow adjustment mechanism 25 is an orifice, it is preferable to provide a straight pipe portion (Lo) that extends from the outlet end of the orifice to the outlet of the coal primary port 22, specifically, to the inlet ends of the splitting members 24A, in order to eliminate the influence of the orifice. is necessary to ensure that the length of the straight pipe portion (Lo) is at least 2 h or more, where h indicates the height of the coal primary port 22, and, more preferably, the length of the straight pipe portion (Lo) is 10 h or more.

When this flow adjustment mechanism 25 is provided, it is possible to eliminate flow rate deviation in which an imbalance is caused in the distribution in a cross section of the flow path when pulverized coal, serving as powdered fuel, is influenced by a centrifugal force after passing through a vent provided in the flow path for supplying the pulverized coal and primary air to the coal primary port 22.

Specifically, although the pulverized coal conveyed by the primary air has, after passing through the vent, a distribution deviating outward (in the direction of increasing vent diameter), when the pulverized coal passes through the flow adjustment mechanism 25, the distribution in a cross section of the flow path is eliminated, and the pulverized coal flows into the splitting members 24A almost uniformly. As a result, the pulverized-coal burner 21 having the flow adjustment mechanism 25 can effectively utilize the internal flame stabilizing mechanism constituted by the splitting members 24A.

Further, in the above-described embodiment and modifications thereof, the splitting members 24 are arranged in a plurality of (vertical and horizontal) directions at the flow-path front part of the coal primary port 22; however, one or more splitting members 24 may be provided in the horizontal direction or in the vertical direction. When such splitting members 24 are provided, since they function as the internal flame stabilizing mechanism near the center of the outlet opening of the pulverized-coal burner 21, internal flame stabilization can be realized by the splitting members 24, and the center portion becomes more deficient in air, thus facilitating NOx reduction.

Second Embodiment

Figure 10A:
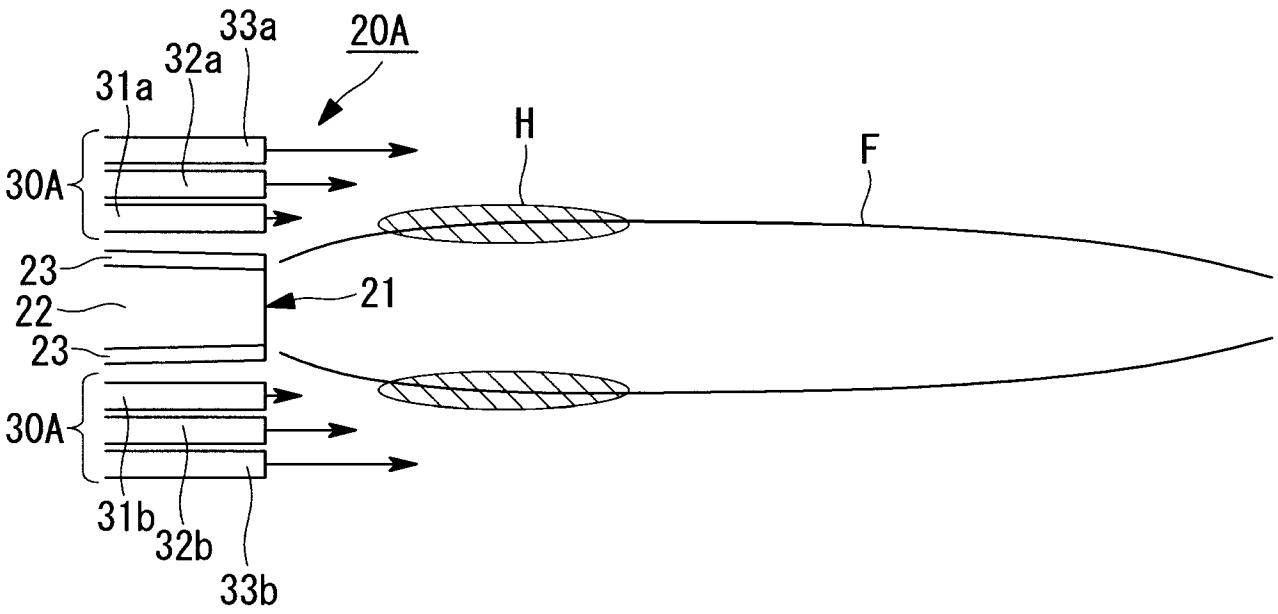
FIG. 10A is a vertical cross-sectional view showing a solid-fuel-fired burner according to a second embodiment, of the present invention.
Figure 10B:
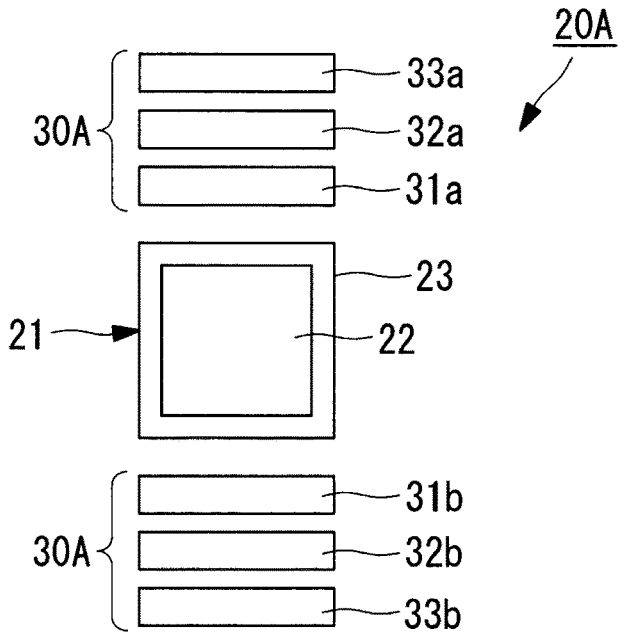
FIG. 10B is a front view of the solid-fuel-fired burner shown in FIG. 10A, as viewed from the inside of the furnace.

Next, a solid-fuel-fired burner according to a second embodiment of the present invention will be described based on FIGS. 10A to 10C. Note that identical reference symbols are assigned to the same items as those in the above-described embodiment, and a detailed description thereof will be omitted.

In a solid-fuel-fired burner 20A shown in the figures, the pulverized-coal burner 21 includes the rectangular coal primary port 22 that injects pulverized coal conveyed by primary air and the coal secondary port 23 that is provided so as to surround the coal primary port 22 and that injects part of secondary air.

Secondary-air injection ports 30A for injecting secondary air are provided above and below the solid-fuel-fired burner 21. The secondary-air injection ports 30A are each divided into a plurality of independent flow paths and ports, and the flow paths are provided with the respective dampers 40 that can adjust the degrees of opening thereof, as secondary-air airflow adjustment means.

In a configuration example shown in the figures, both of the secondary-air injection ports 30A disposed above and below the pulverized-coal burner 21 are vertically divided into three ports, which are inner secondary-air ports 31*a* and 31*b*, middle secondary-air ports 32*a* and 32*b*, and outer secondary-air ports 33*a* and 33*b*, disposed in that order from the inner side close to the pulverized-coal burner 21 to the outer side. Note that the number of ports into which the secondary-air injection ports 30 are each divided is not limited to three and can be appropriately changed according to the conditions.

Figure 10C:
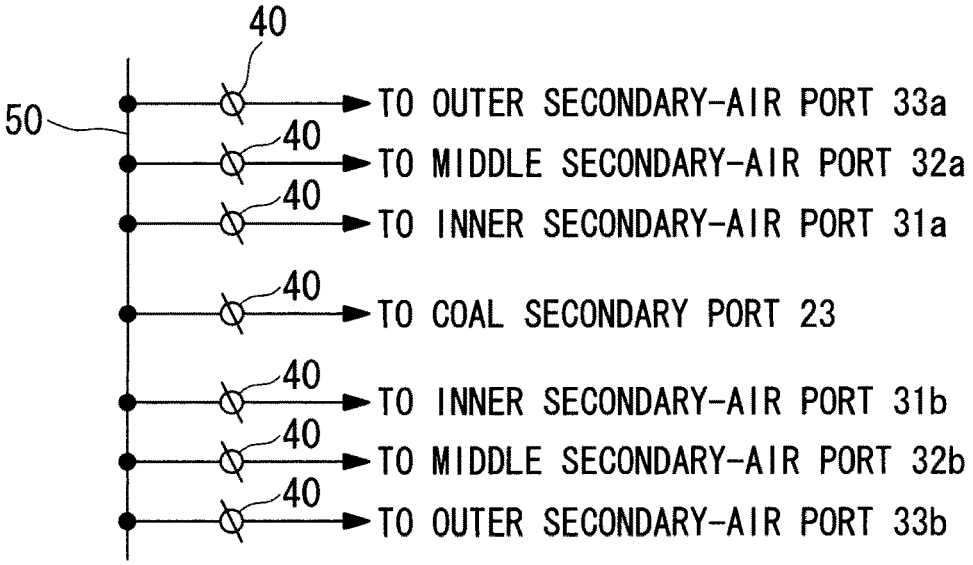
FIG. 10C is a diagram showing an air supply system for supplying air to the solid-fuel-fired burner shown in FIGS. 10A and 10B.

The above-described coal secondary port 23, inner secondary-air ports 31*a* and 31*b*, middle secondary-air ports 32*a* and 32*b*, and outer secondary-air ports 33*a* and 33*b* are each connected to an air supply line 50 having an air supply source (not shown), as shown in FIG. 10C, for example. The dampers 40 are provided in flow paths that are branched from the air supply line 50 to communicate with the respective ports. Therefore, by adjusting the degree of opening of each of the dampers 40, the amount of secondary air to be supplied can be independently adjusted for each of the ports.

With the solid-fuel-fired burner 20A and the tangential firing boiler 10 that includes the solid-fuel-fired burner 20A, since each solid-fuel-fired burner 20A includes the pulverized-coal burner 21, which injects pulverized coal and air, and the secondary-air injection ports 30A each divided into three ports and disposed above and below the pulverized-coal burner 21, it is possible to perform flow-rate distribution such that the amount of secondary air to be injected into the outer circumference of the flame F is set to a desired value by adjusting the degree of opening of the damper 40 for each of the ports into which the secondary-air injection ports 30A are divided.

Therefore, when the distribution proportion of the amount of secondary air to be injected into the inner secondary-air ports 31*a* and 31*b*, which are closest to the outer circumference of the flame F, is decreased, and those of the amounts of secondary air to be injected into the middle secondary-air ports 32*a* and 32*b* and the outer secondary-air ports 33*a* and 33*b* are sequentially increased in proportion to the decrease, it is possible to suppress a local high-temperature oxygen remaining region (hatched portion in the figure) H formed at the outer circumference of the flame F.

In other words, when the proportion of the amount of secondary air to be injected into an outer side away from the flame F is increased, and the proportion of the amount of secondary air to be injected into the vicinity of the outer circumference of the flame F is decreased, diffusion of secondary air can be delayed. As a result, concentration of secondary air at the circumference of the flame F can be prevented or suppressed, and therefore, the local high-temperature oxygen remaining region H is weakened and decreased in size, thereby decreasing the amount of NOx produced in the tangential firing boiler 10. In other words, when the amount of secondary air to be injected into the outer circumference of the flame F is properly specified, formation of the high-temperature oxygen remaining region H can be suppressed or prevented to achieve a decrease in the amount of NOx in the tangential firing boiler 10.

On the other hand, when diffusion of secondary air is required due to the properties of the pulverized coal or the like, it is necessary merely to reverse the distribution proportions for the secondary-air injection ports 30A, specifically, to increase the distribution proportions for the inner secondary-air ports 31*a* and 31*b*.

Specifically, even when pulverized coal obtained by pulverizing coal having a different fuel ratio, such as that including a large amount of volatile components, is used, the flow-rate distribution of secondary air to be injected from each of the ports into which the secondary-air injection ports 30A are divided is appropriately adjusted, thereby making it possible to select either appropriate combustion with a decrease in the amount of NOx or unburned fuel.

Dividing the secondary-air injection ports 30A into a plurality of ports to provide multiple stages in this way can also be applied to the solid-fuel-fired burner 20 described above in the first embodiment.

Figure 11A:
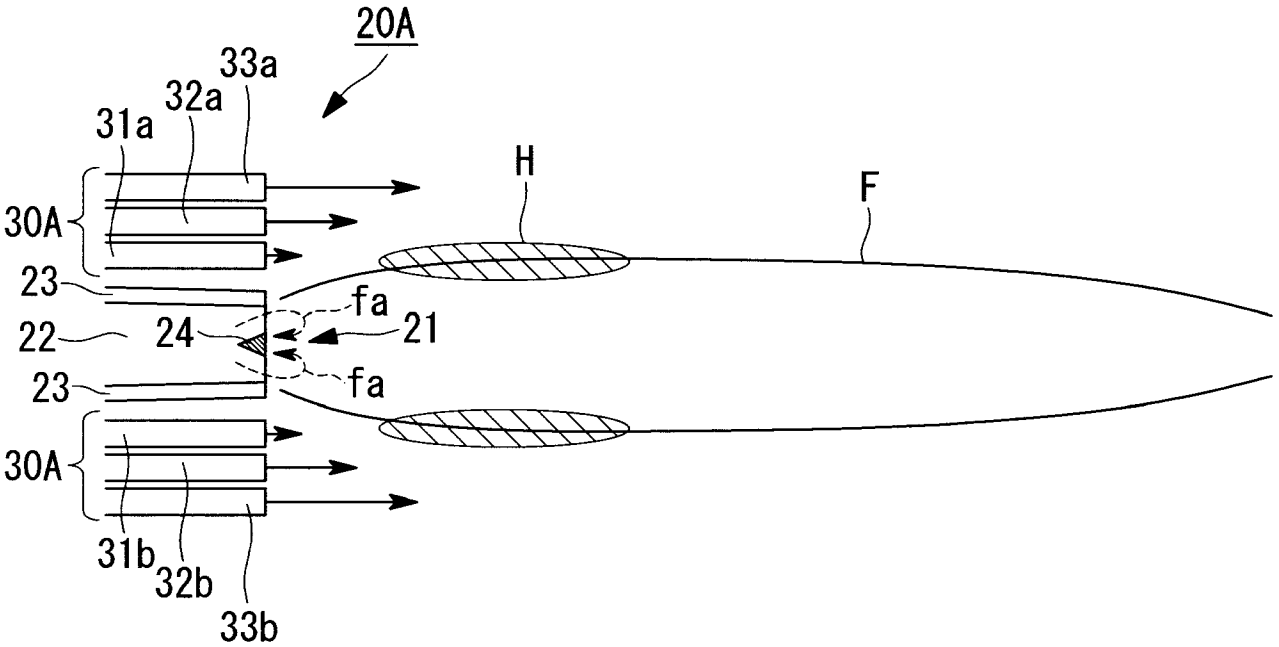
FIG. 11A is a vertical cross-sectional view showing a configuration example of the solid-fuel-fired burner provided with a splitting member, as a first modification of the solid-fuel-fired burner shown in FIGS. 10A to 10C.
Figure 11B:
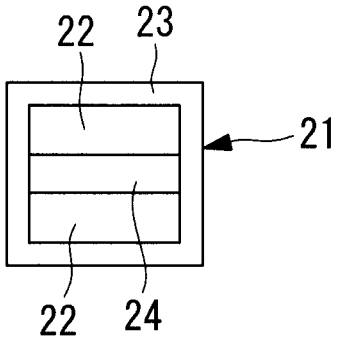
FIG. 11B is a front view of the solid-fuel-fired burner shown in FIG. 10A, as viewed from the inside of the furnace.

Incidentally, as in a first modification of this embodiment, shown in FIGS. 11A and 11B, for example, the above-described solid-fuel-fired burner 20A is preferably provided with a splitting member 24 disposed at a nozzle end of the pulverized-coal burner 21 so as to vertically split the opening area.

The splitting member 24 shown in the figures has a triangular shape in cross section and is disposed so as to vertically split and diffuse pulverized coal and primary air that flow in the nozzle, thereby enhancing flame stabilization and suppressing or preventing formation of the high-temperature oxygen remaining region H.

Specifically, when pulverized coal and primary air pass through the splitting member 24, a flow of a high concentration of pulverized coal is formed at the outer circumference of the splitting member 24, which is effective to enhance flame stabilization. The flow of a high concentration of pulverized coal formed by passing through the splitting member 24 flows into a negative-pressure area formed on a downstream side of the splitting member 24, as indicated by dashed arrows fa in the figure. As a result, the flame F is also drawn into the negative-pressure area due to this air flow, thereby further enhancing the flame stabilization and thus, facilitating combustion to rapidly consume oxygen.

Note that the number of splitting members 24 is not limited to one, and, for example, a plurality of splitting members 24 may be provided in the same direction or a plurality of splitting members 24 may be provided in different directions, as described in the first embodiment. Further, the cross-sectional shape of the splitting member 24 may be appropriately modified.

Figure 12:
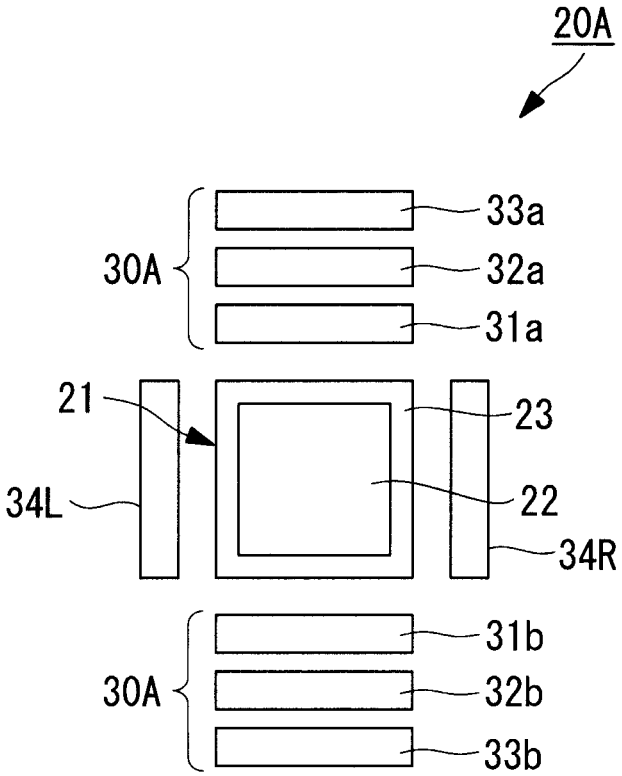
FIG. 12 is a front view of the solid-fuel-fired burner provided with lateral secondary-air ports, as viewed from the inside of the furnace, as a second modification of the solid-fuel-fired burner shown in FIGS. 10A to 10C.

Furthermore, as in a second modification of this embodiment, shown in FIG. 12, for example, the above-described solid-fuel-fired burner 20A is preferably provided with one or more lateral secondary-air ports 34R and one or more lateral secondary-air ports 34L at right and left sides of the pulverized-coal burner 21. In a configuration example shown in the figure, one lateral secondary-air port 34R and one lateral secondary-air port 34L, which are each provided with a damper (not shown), are provided on the right and left sides of the pulverized-coal burner 21; but they may be each divided into a plurality of ports whose the flow rate can be controlled.

With this configuration, secondary air can also be distributed to the right and left sides of the flame F, thereby preventing excessive secondary air at the upper and lower sides of the flame F. In other words, the distribution of the amount of secondary air to be injected into the upper and lower sides and the right and left sides of the outer circumference of the flame F can be appropriately adjusted, thereby allowing more precise flow rate distribution.

Those lateral secondary-air ports 34L and 34R can also be applied to the above-described first embodiment.

Figure 13:
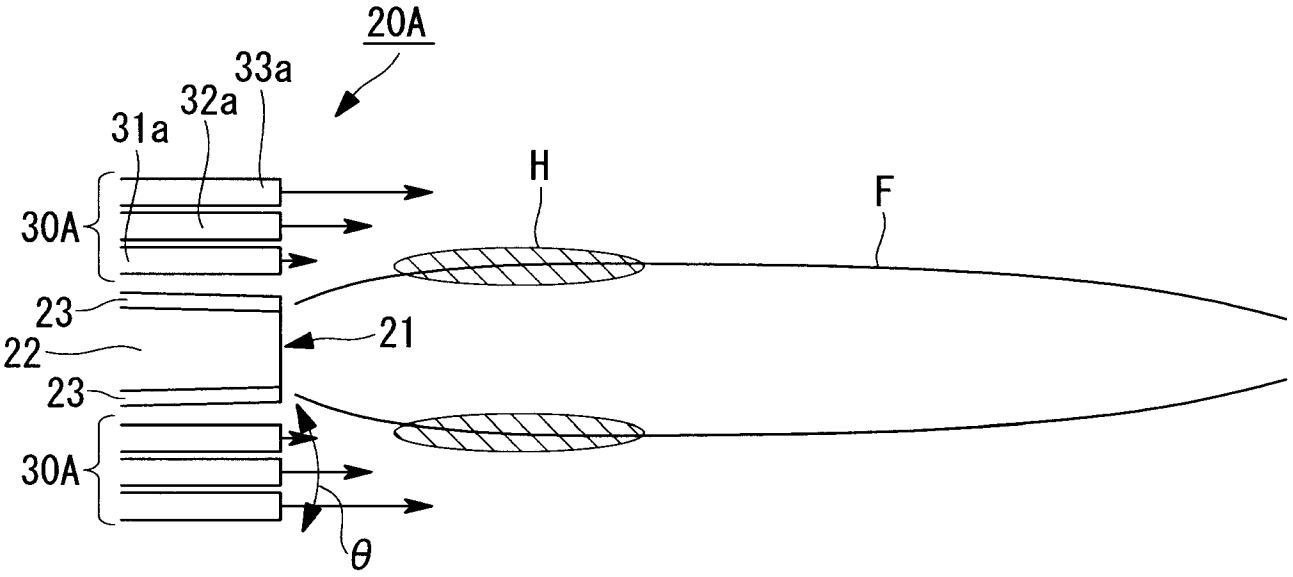
FIG. 13 is a vertical cross-sectional view showing a configuration example in which a secondary-air injection port of the solid-fuel-fired burner shown in FIG. 10A is provided with an angle adjustment mechanism.

Further, in the above-described tangential firing boiler 10, the secondary-air injection port 30A is preferably provided with an angle adjustment mechanism that vertically changes the injection direction of secondary air toward the inside of the furnace 11, as shown in FIG. 13, for example. The angle adjustment mechanism vertically changes a tilt angle θ of the secondary-air injection port 30A relative to a level position and facilitates the diffusion of secondary air, preventing or suppressing the formation of the high-temperature oxygen remaining region H. Note that, in this case, a suitable tilt angle θ is approximately ±30 degrees, and a more desirable tilt angle θ is ±15 degrees.

With this angle adjustment mechanism, since the angle at which secondary air is injected from the secondary-air injection port 30A toward the flame F in the furnace 11 can be adjusted, air diffusion in the furnace 11 can be more precisely controlled. In particular, in a case where the type of pulverized coal fuel is significantly changed, if the angle of injection of secondary air is appropriately changed, the NOx decrease effect can be further improved.

This angle adjustment mechanism can also be applied to the above-described first embodiment.

Further, in the above-described tangential firing boiler 10, it is preferable that the distribution of the amounts of air to be injected from the secondary-air injection ports 30A be adjusted through feedback control of the degrees of opening of the dampers 40, based on the amounts of unburned fuel and NOx emission.

Specifically, in the tangential firing boiler 10, when the amount of unburned fuel is high, the distribution of secondary air to the inner secondary-air ports 31*a* and 31*b*, which are close to the outer circumferential surface of the flame F, is increased; and, when the amount of NOx emission is high, the distribution of secondary air to the outer secondary-air ports 33*a* and 33*b*, which are far from the outer circumferential surface of the flame F, is increased.

In this case, an instrument for measuring the carbon concentration from scattering of laser light can be used to measure the amount of unburned fuel, and a known measurement instrument can be used to measure the amount of NOx emission. When this feedback control is performed, the tangential firing boiler 10 can automatically optimize the distribution of secondary air according to the combustion state.

Further, in the above-described tangential firing boiler 10, the amounts of secondary air to be injected from the secondary-air injection ports 30A are preferably distributed among multi-stage air injections, which make a region from the burner section 12 to the AA section 14 the reducing atmosphere.

Specifically, the amount of secondary air to be injected from the secondary-air injection ports 30A, which are each divided into a plurality of ports, can be decreased by using two-stage combustion in which air is also injected from the AA section 14 in a multi-stage fashion. Therefore, the amount of NOx produced can be further decreased due to the synergy between a decrease in NOx through suppression of the high-temperature oxygen remaining region H formed at the outer circumference of the flame F and a decrease in NOx in combustion exhaust gas, caused by providing the reducing atmosphere.

In this way, according to the above-described tangential firing boiler 10 of the present invention, since the amount of secondary air to be injected from the secondary-air injection ports 30A that are each divided into a plurality of ports is adjusted for each of the ports, it is possible to prevent or suppress concentration of secondary air at the outer circumference of the flame F, and thus, to suppress the high-temperature oxygen remaining region H formed at the outer circumference of the flame F, thus decreasing the amount of NOx produced.

In the above-described embodiments, although a description has been given of the tangential firing boiler 10, in which air is injected in a multi-stage fashion to make the region from the burner section 12 to the AA section 14 the reducing atmosphere, the present invention is not limited thereto.

Figure 14:
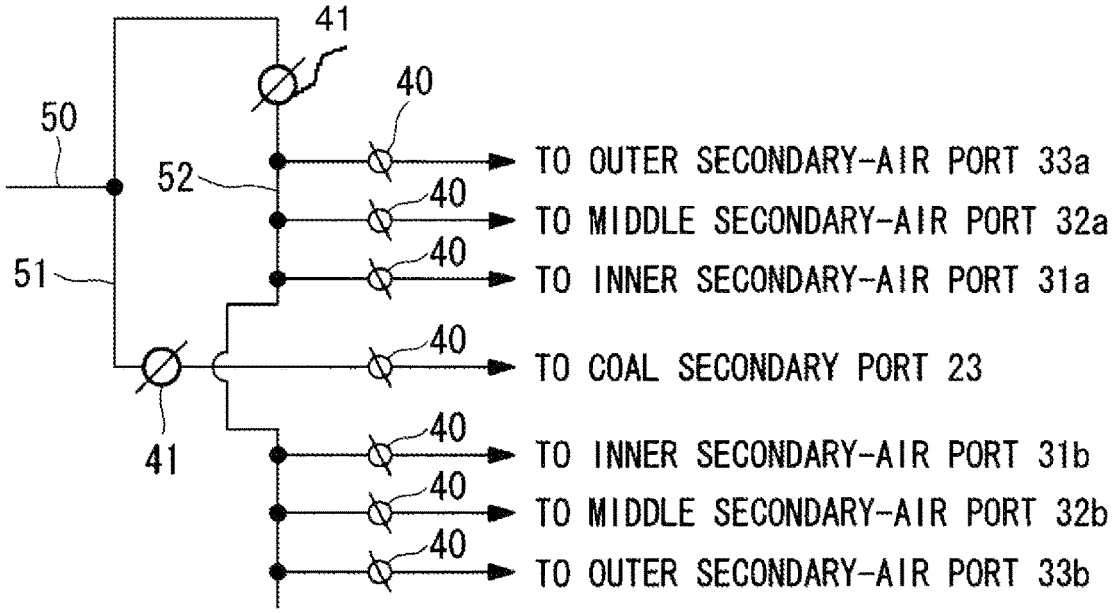
FIG. 14 is a diagram showing a modification of the air supply system shown in FIG. 10C.

Further, as shown in FIG. 14, for example, in the above-described solid-fuel-fired burner 20A, it is preferable to separate a system for supplying air to the coal secondary port 23 of the pulverized-coal burner 21 from a system for supplying air to the secondary-air injection ports 30A. In a configuration example shown in the figure, the air supply line 50 is divided into a coal secondary port supply line 51 and a secondary-air injection port supply line 52, and the supply lines 51 and 52 are provided with dampers 41.

With such air supply systems, it is possible to distribute the amount of air by adjusting the degree of openings of the respective dampers 41 for the coal secondary port supply line 51 and the secondary-air injection port supply line 52 and to further adjust the amount of air for each port by adjusting the degree of opening of each of the dampers 40. As a result, the amount of air for each port can be reliably adjusted even when the secondary-air injection ports 30A are each divided into a plurality of ports to provide multiple stages.

Figure 15:
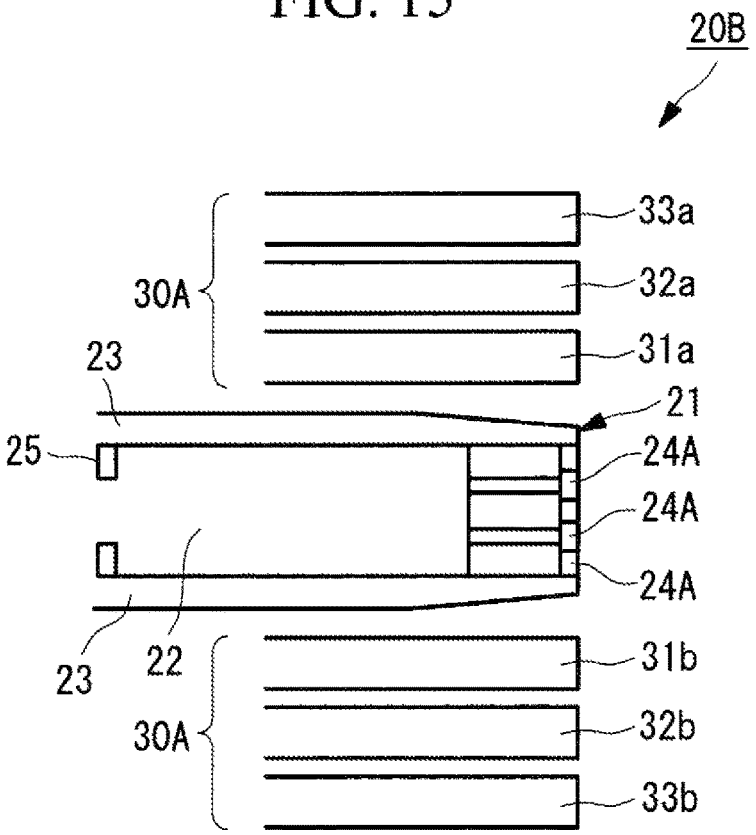
FIG. 15 is a vertical cross-sectional view of a solid-fuel-fired burner, showing a configuration example in which the third modification of the first embodiment, shown in FIG. 9, and the second embodiment, shown in FIGS. 10A to 10C, are combined.

The above-described first and second embodiments are not limited to separate use but may also be used in combination. In a solid-fuel-fired burner 20B shown in FIG. 15, both of the secondary-air injection ports 30A disposed above and below the pulverized-coal burner 21 shown in FIG. 9 are each divided into three ports in the vertical direction. Specifically, the solid-fuel-fired burner 20B shown in the figure has an example configuration in which internal flame stabilization realized by the splitting members 24A and the flow adjustment mechanism 25 is combined with the multi-stage secondary-air injection ports 30A.

Since the thus-configured solid-fuel-fired burner 20B can decrease the amount of NOx through the internal flame stabilization and also can adjust the diffusion speed of secondary air to optimize air diffusion in the flame, the required amount of air for combustion of volatile components and char can be supplied at an appropriate timing. In other words, by performing the internal flame stabilization and the secondary-air diffusion speed adjustment, a further decrease in the amount of NOx can be achieved due to the synergy of the two.

Note that the cross-sectional shape and the arrangement of the splitting members 24, the presence or absence of the flow adjustment mechanism 25, the division count of the secondary-air injection port 30A, and the presence or absence of the lateral secondary-air ports 34L and 34R are not limited to those in the configurations shown in the figures, and a configuration in which the above-described items are appropriately selected and combined can be used.

Further, in the embodiment and the modifications in which the multi-stage secondary-air injection ports 30A are used, some of the secondary-air injection ports 30A can be used as oil ports.

Specifically, in a solid-fuel-fired boiler such as the tangential firing boiler 10, an operation performed using gas or oil as fuel is necessary to start up the boiler, thus requiring an oil burner for injecting oil to the furnace 11. Then, in a start-up period requiring the oil burner, the outer secondary-air ports 33*a* and 33*b* of the multi-stage secondary-air injection ports 30A are temporarily used as oil ports, for example, and thus, it is possible to decrease the number of ports used in the solid-fuel-fired burner, reducing the height of the boiler.

Figure 16:
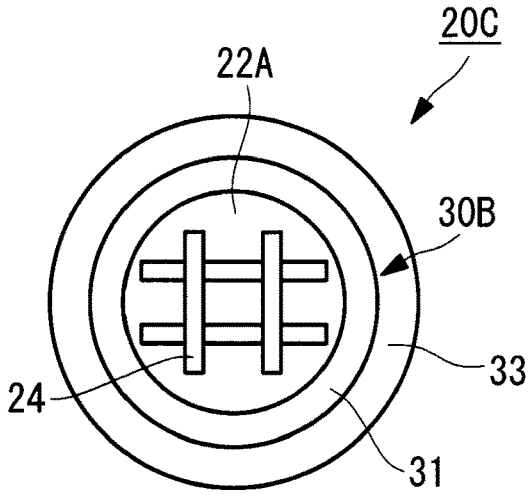
FIG. 16 is a front view of a solid-fuel-fired burner suitable for use in a wall firing boiler, as viewed from the inside of the furnace.

Next, a solid-fuel-fired burner suitable for use in a wall firing boiler will be described with reference to FIG. 16.

In a solid-fuel-fired burner 20C shown in the figure, a secondary-air injection port 30B that includes a plurality of concentric ports is provided at the outer circumference of a coal primary port 22A having a circular shape in cross section. The secondary-air injection port 30B shown in the figure is constituted of two stages, i.e., an inner secondary-air injection port 31 and an outer secondary-air injection port 33, but the configuration of the secondary-air injection port 30B is not limited thereto.

Further, a total of four splitting members 24 in two different (vertical and horizontal) directions are arranged in a grid-like pattern at the center of the outlet of the coal primary port 22A. Note that the number of the splitting members 24, the arrangement thereof, and the cross-sectional shape thereof described in the first embodiment can be applied to the splitting members 24 used in this case.

Since the thus-configured solid-fuel-fired burner 20C gradually supplies secondary air, it does not provide excessive reducing atmosphere but generally provides a short flame and a strong reducing atmosphere, thereby decreasing sulfide corrosion etc. caused by produced hydrogen sulfide.

In this way, in the solid-fuel-fired burners of the above-described embodiments and modifications, since the splitting members arranged in a plurality of directions that function as the internal flame stabilizing mechanism are provided at the outlet opening of the pulverized-coal burner, the flow path of powdered fuel and air is divided to disturb the flow thereof, in the vicinity of the center of the outlet opening of the fuel burner where the splitting members cross. Since this disturbance facilitates mixing and diffusion of air even in the flame, and further, the splitting members divide the ignition surface to make it easy for oxygen to come into the center portion of the flame, the ignition position comes close to the center of the flame, decreasing the amount of unburned fuel. Specifically, since internal ignition is effectively performed by using oxygen in the flame center portion, reduction rapidly proceeds in the flame, and, as a result, the amount of NOx produced eventually emitted from the solid-fuel-fired boiler having the solid-fuel-fired burner is decreased.

Further, when the secondary-air injection ports are made to provide multiple stages to adjust the injection of secondary air, concentration of the secondary air at the outer circumference of the flame can be prevented or suppressed, thereby suppressing the high-temperature oxygen remaining region formed at the outer circumference of the flame, decreasing the amount of nitrogen oxide (NOx) produced.

Further, since the solid-fuel-fired burner and the solid-fuel-fired boiler having the solid-fuel-fired burner according to the present invention can perform powerful ignition in the flame and can increase the air ratio in the burner section, it is possible to decrease the excess air rate in the entire boiler to approximately 1.0 to 1.1, thus leading to a boiler-efficiency improving effect. Note that a conventional solid-fuel-fired burner and a conventional solid-fuel-fired boiler are usually operated at an excess air rate of approximately 1.15, and thus, the air ratio can be decreased by approximately 0.05 to 0.15.

FIGS. 17 to 22 are graphs of experimental results showing advantages of the present invention.

Figure 17:
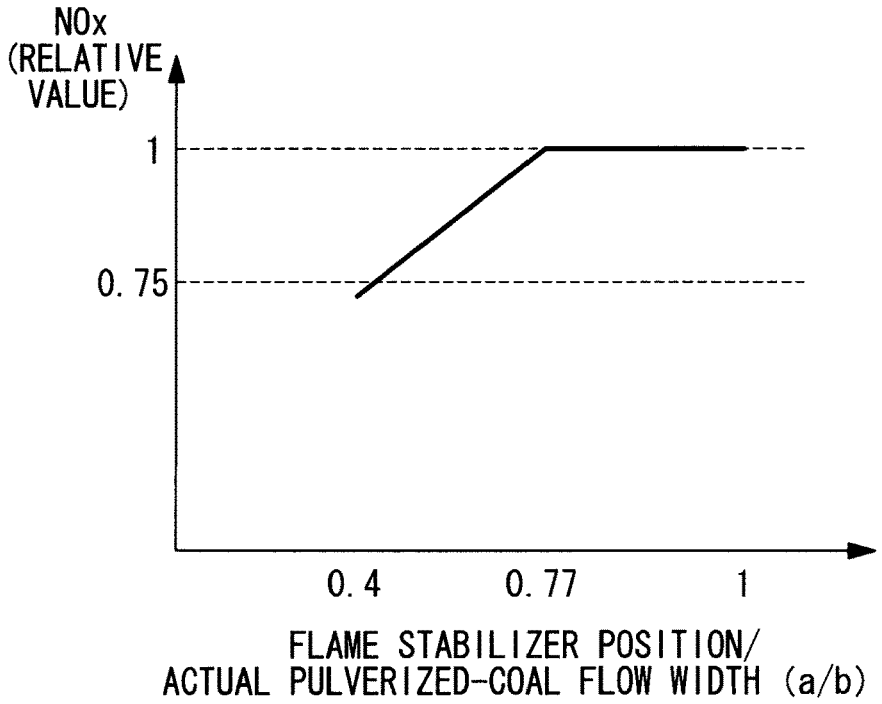
FIG. 17 is a graph of an experimental result showing the relationship between a flame stabilizer position in internal flame stabilization (flame stabilizer position/actual pulverized-coal flow width) and the amount of NOx produced (relative value).
Figure 18:
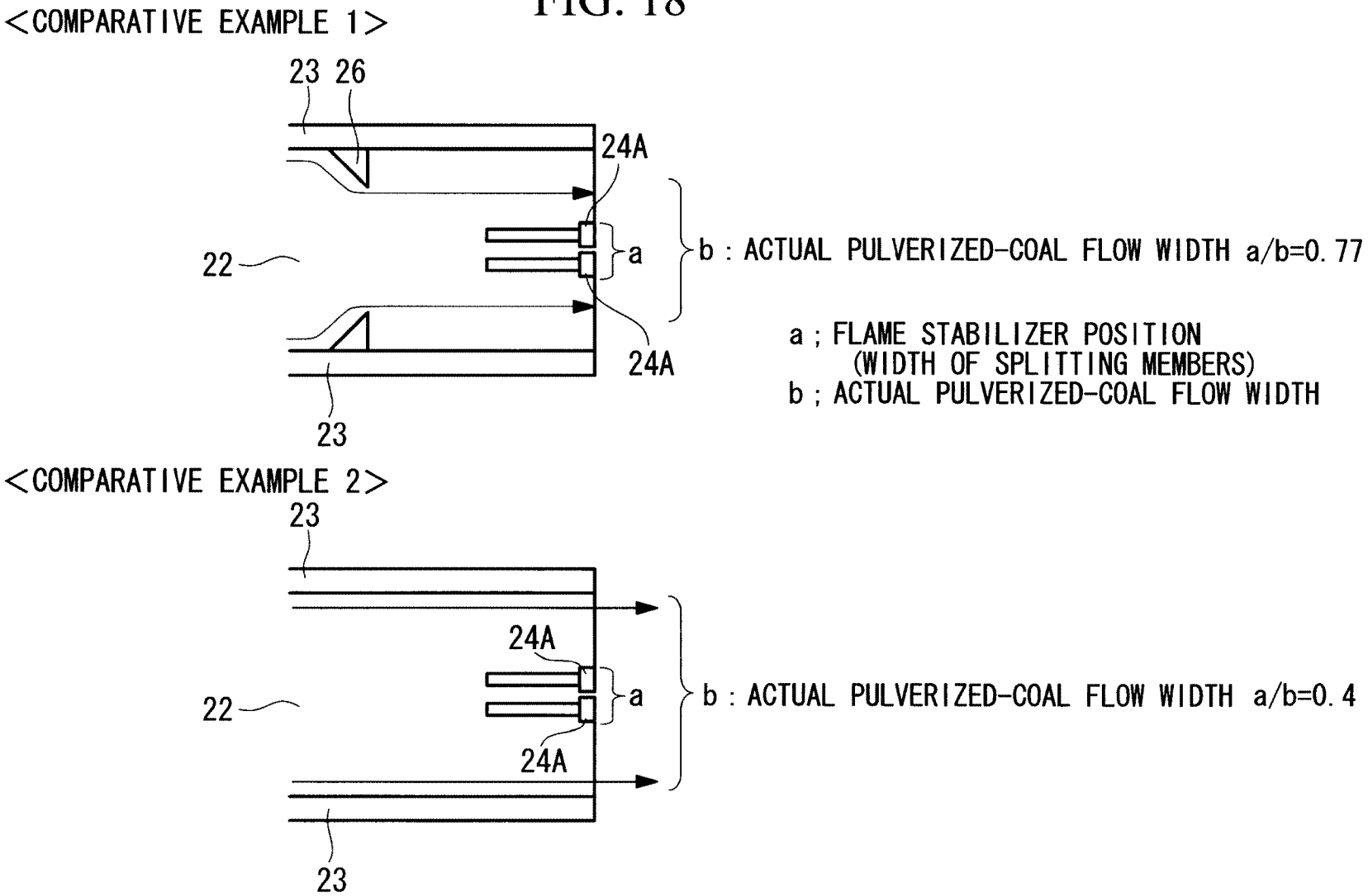
FIG. 18 shows views of comparative examples of a fuel burner, for explaining the flame stabilizer position indicated in the graph shown in FIG. 17

FIG. 17 is a graph of an experimental result showing the relationship between a flame stabilizer position in internal flame stabilization and the amount of NOx produced (relative value). In this case, the width (height) of the splitting members 24A functioning as a flame stabilizer is indicated by flame stabilizer position a, and the width of a flow path in which pulverized coal actually flows is indicated by actual pulverized-coal flow width b, in comparative examples shown in FIG. 18. In the graph, "a/b" is indicated on the horizontal axis, and the relative value of the amount of NOx produced is indicated on the vertical axis. Note that, although the splitting member 24A shown in FIG. 6B is employed in FIG. 18, the type of a splitting member is not limited thereto.

In this experiment, the amounts of NOx produced in Comparative Example 1 (a/b=0.77) and Comparative Example 2 (a/b=0.4) were measured with the same flow velocity of primary air and pulverized coal, the same flow velocity of secondary air, and the same air distribution between primary air and secondary air.

Here, in the coal primary port 22 used in Comparative Example 1, an inverted core 26 serving as an obstacle is disposed in the flow path, and therefore, pulverized coal flows out with a width b that approximately matches the width of the inner wall of the inverted core 26. On the other hand, in the coal primary port 22 used in Comparative Example 2, pulverized coal flows along the inner wall of a flow path having no obstacle and flows out with a width b that approximately matches the width of the flow path. Therefore, even with the same flame stabilizer position a and the same inner diameter of the coal primary ports 22, the presence or absence of an obstacle causes a difference in the actual pulverized-coal flow width b, which is the denominator, and, as a result, the amount of NOx produced is different.

In other words, the experimental result shown in FIG. 17 indicates that, when the ratio (a/b) of the width a of the splitting members to the actual pulverized-coal flow width b is set to approximately 75% or less, the amount of NOx produced is decreased.

Specifically, according to this experimental result, it is understood that, when the ratio (a/b) of the width a of the splitting members to the actual pulverized-coal flow width b is decreased from 0.77 to 0.4, the relative value of the amount of NOx produced is decreased to 0.75, leading to an approximately 25% decrease. In other words, it is understood that, optimizing the width a of the splitting members functioning as the internal flame stabilizing mechanism is effective to decrease NOx in the solid-fuel-fired burner and the solid-fuel-fired boiler.

At this time, if drifts occur when the flow adjustment mechanism 25 is not provided, the positions of the splitting members may be at an outer side with respect to a flow of pulverized coal, resulting in an increase in NOx. Thus, the flow adjustment mechanism is important.

Figure 19:
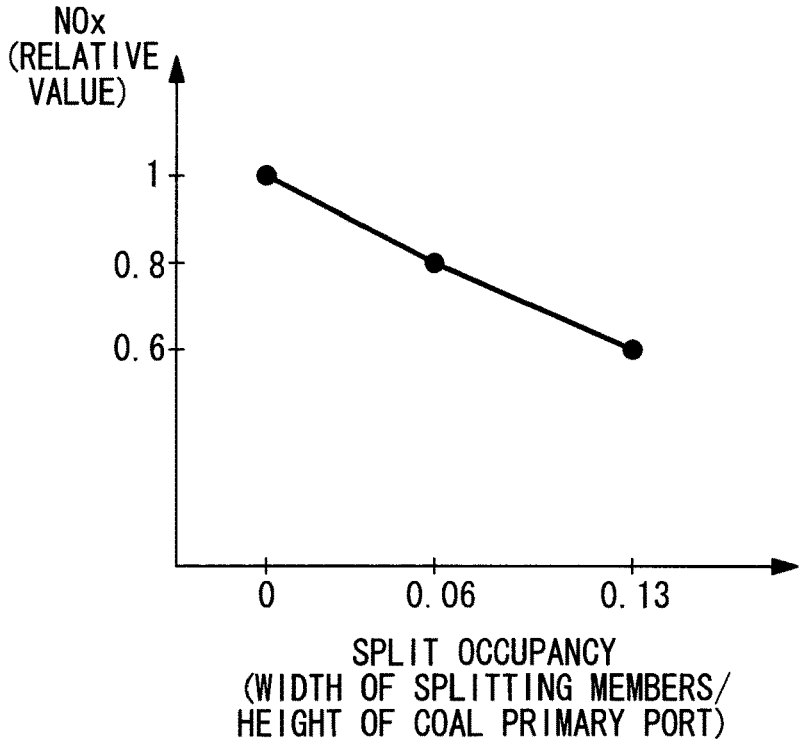
FIG. 19 is a graph of an experimental result showing the relationship between split occupancy and the amount of NOx produced (relative value).

FIG. 19 is a graph of an experimental result showing the relationship between the split occupancy and the amount of NOx produced (relative value). Specifically, it is an experimental graph showing how the amount of NOx produced changes according to the ratio of the above-described width a of the splitting members to the height (width) of the coal primary port 22.

According to this experimental result, the larger the split occupancy is, the smaller the amount of NOx produced is; and therefore, it is understood that installation of splitting members is effective to decrease NOx.

On the other hand, according to the above-described experimental result shown in FIG. 17, when the ratio (a/b) of the width a of the splitting members to the actual pulverized-coal flow width b is decreased, the relative value of the amount of NOx produced is also decreased, and thus, installation of splitting members having an appropriate width a is necessary to decrease the amount of NOx produced. In other words, in internal flame stabilization, to decrease the amount of NOx produced, it is important to provide splitting members having an appropriate width a to enhance ignition, thereby more quickly emitting and reducing NOx.

Figure 20:
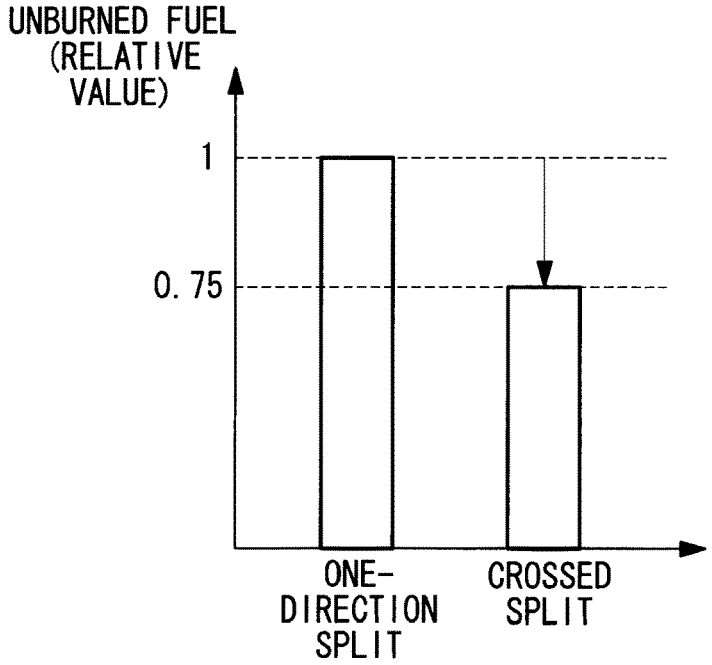
FIG. 20 is a graph of an experimental result showing relative values of the amounts of unburned fuel produced in one-direction split and crossed split.

FIG. 20 shows a comparison of the amount of unburned fuel produced for the case of a one-direction split in which splitting members are disposed in one direction and the case of a crossed split in which splitting members are arranged in a plurality of directions. In this experiment, the same conditions as those in the experiment shown in FIG. 17 are specified, and the amount of unburned fuel produced is compared between the one-direction split and the crossed split.

According to the experimental result, the relative value of the amount of unburned fuel produced when the crossed split is used is 0.75 relative to the amount of unburned fuel produced when the one-direction split is used, and it is understood that the amount of unburned fuel produced is decreased by approximately 25%. Specifically, the crossed split, in which the splitting members are arranged in a plurality of directions, is effective to decrease the amount of unburned fuel in the solid-fuel-fired burner and the solid-fuel-fired boiler.

From the experimental result shown in FIG. 20, it conceivable that, by disposing the splitting members in different directions, ignition in the flame is further enhanced, and diffusion of air into the inside of the flame is improved, thereby decreasing the amount of unburned fuel.

On the other hand, it is conceivable that the amount of unburned fuel is higher when the one-direction split is used because air is supplied to the outer side of the flame, thus delaying air diffusion into the flame formed at the inner side.

Figure 21:
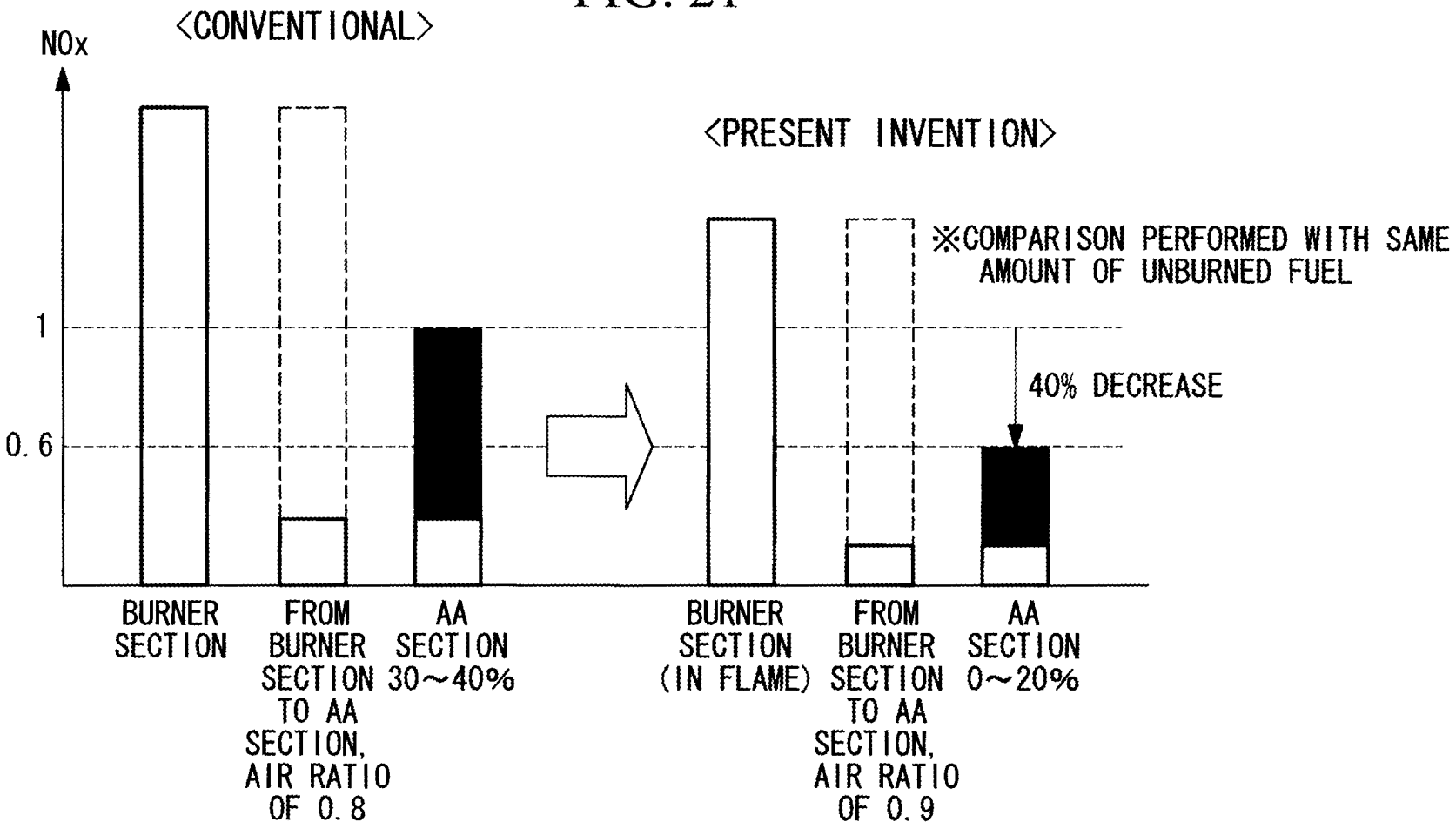
FIG. 21 is a graph of an experimental result showing relative values of the amounts of NOx produced in a burner section, in a region between the burner section and an AA section, and in the AA section, comparing a conventional technology and the present invention.

An experimental result shown in FIG. 21 is obtained by comparing the amounts of NOx produced in a burner section, in a region from the burner section to an AA section, and in the AA section, for a conventional solid-fuel-fired burner and the solid-fuel-fired burner of the present invention; and values relative to the amount of NOx produced in the AA section of the conventional solid-fuel-fired burner, which is set to a reference value of 1, are shown. Note that splitting members arranged in a plurality of directions, as shown in FIG. 1A, for example, are employed to obtain this experimental result.

Further, this experimental result is obtained through comparison at the same amount of unburned fuel, and the air ratio (the ratio of the amount of injected air that is obtained by subtracting the amount of injected additional air from the total amount of injected air, relative to the total amount of injected air) in the region from the burner section to the AA section is set to 0.8 in the conventional technology and is set to 0.9 in the present invention. The total amount of injected air used herein is an actual amount of injected air determined in consideration of the excess air rate. Note that when the additional-air injection rate is set to 30%, and the excess air rate is set to 1.15, the air ratio in the region from the burner section to the AA section is approximately 0.8 (the air ratio in the region from the burner section to the AA section$=1.15\times(1-0.3)\approx0.8$).

According to this experimental result, the amount of NOx eventually produced from the AA section is decreased to 0.6, a 40% decrease compared with the conventional technology. It is conceivable that this is because the present invention employs internal flame stabilization by arranging splitting members in a plurality of directions to further enhance ignition by the splitting members, thereby producing NOx in the flame and effectively reducing the NOx.

Furthermore, in the present invention, since mixing in the flame is excellent, the combustion approaches premix combustion, providing more uniform combustion, and thus, it is confirmed that a sufficient reducing capability is afforded even at an air ratio of 0.9.

Specifically, in the conventional technology, since a high-temperature high-oxygen region is formed at the outer circumference of the flame, and thus, approximately 30% of additional air injection (AA) is required to sufficiently reduce NOx, it is necessary to decrease the air ratio in the region from the burner section to the AA section to approximately 0.8. Therefore, since approximately 30% of the total amount of injected air, determined in consideration of the excess air rate, is injected into the AA section, NOx is produced also in the AA section.

However, in the present invention, since combustion can be performed even at the air ratio of approximately 0.9 in the region from the burner section to the AA section, the amount of injected additional air can be decreased to approximately 0 to 20% of the total amount of injected air, determined in consideration of the excess air rate. Therefore, the amount of NOx produced in the AA section can also be suppressed, thereby eventually allowing an approximately 40% decrease in the amount of NOx produced.

Figure 22:
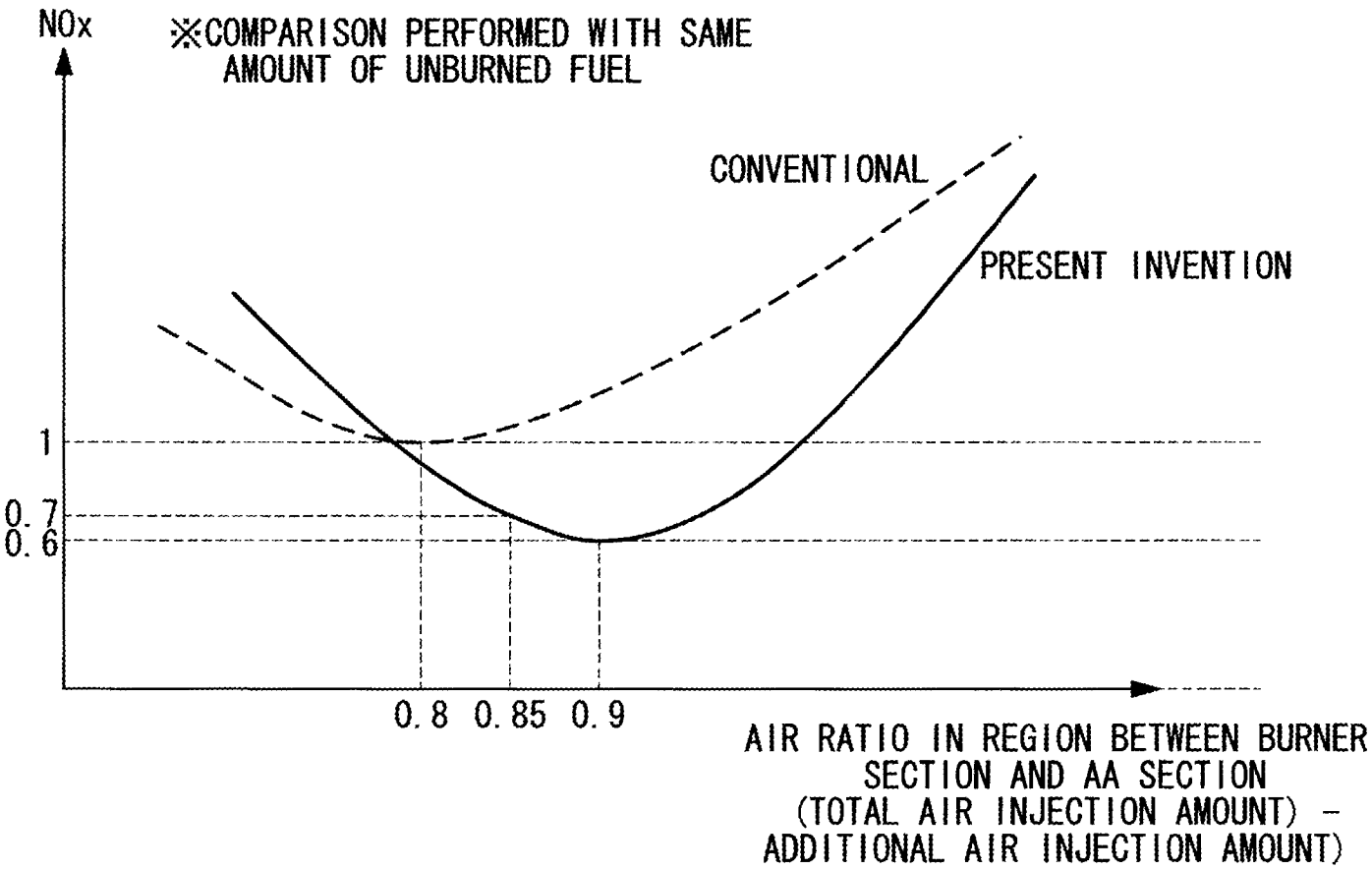
FIG. 22 is a graph of an experimental result showing the relationship between an air ratio in the region between the burner section and the AA section and the amount of NOx produced (relative value), comparing a conventional technology and the present invention.

In FIG. 22, the horizontal axis indicates the air ratio in the region from the burner section to the AA section, and the vertical axis indicates the relative value of the amount of NOx produced. According to this experimental result, in the present invention, an air ratio of 0.9 is the optimal value in the vicinity of the burner, at which an approximately 40% decrease in NOx has been confirmed. Therefore, from FIG. 22, the air ratio in the region from the burner section to the AA section, which is the ratio of the amount of injected air obtained by subtracting the amount of injected additional air from the total amount of injected air to the total amount of injected air determined in consideration of the excess air rate, is preferably set to 0.85 or more, at which the amount of NOx can be decreased by approximately 30, and is more preferably set to the optimal value of 0.9 or more.

In the experimental result of the present invention, the amount of NOx produced is increased to 1 or more around the air ratio of 0.8 because NOx is produced due to the injection of additional air.

Further, the upper limit of the air ratio differs depending on the fuel ratio: it is 0.95 when the fuel ratio is 1.5 or more, and it is 1.0 when the fuel ratio is less than 1.5. The fuel ratio in this case is the ratio of fixed carbon to volatile components (fixed carbon/volatile components) in fuel.

In this way, according to this embodiment, described above, the pulverized-coal burner 21, which has internal flame stabilization, and the secondary-air injection ports 30, which do not perform flame stabilization, are provided, and the air ratio in the pulverized-coal burner 21 is set to 0.85 or more, preferably, to 0.9 or more, thereby decreasing the amount of injected additional air in the AA section 14 and also decreasing the amount of NOx produced in the AA section 14. Further, since the high-temperature oxygen remaining region H formed at the outer circumference of the flame is suppressed, and NOx produced in the flame, in which combustion approaching premix combustion is achieved, is effectively reduced, the amount of NOx eventually emitted from the AA section 14 is decreased by a decrease in the amount of NOx reaching the AA section 14 and by a decrease in the amount of NOx produced in the AA section 14 due to the injection of additional air.

As a result, in the solid-fuel-fired burner 20 and the tangential firing boiler 10, the amount of eventually produced NOx to be emitted from the AA section 14 is decreased.

Further, by using a solid-fuel-fired burner operating method in which the operation is performed with the air ratio in the pulverized-coal burner 21 set to 0.85 or more, the amount of air (the amount of injected additional air) in the AA section 14 is decreased compared with a case in which the air ratio is 0.8, for example, and thus, the amount of NOx eventually produced is decreased in the AA section 14 where the amount of injected additional air is decreased.

Note that the present invention is not limited to the above-described embodiments, and appropriate modifications can be made without departing from the scope thereof. For example, the powdered solid fuel is not limited to pulverized coal.

REFERENCE SIGNS LIST

10 Tangential firing boiler
11 Furnace
12 Burner section
14 Additional-air injection section (AA section)
20, 20A-20C Solid-fuel-fired burner
21 Pulverized-coal burner (Fuel burner)
22 Coal primary port
23 Coal secondary port

24, 24A, 24B Splitting member
25 Flow adjustment mechanism
30, 30A Secondary-air injection port
31, 31*a*, 31*b* Inner secondary-air port
32*a*, 32*b* Middle secondary-air port
33, 33*a*, 33*b* Outer secondary-air port
34L, 34R Lateral secondary-air port
40, 41 Damper
F Flame
H High-temperature oxygen remaining region

The invention claimed is:

1. A solid-fuel-fired burner that is used in a burner section of a solid-fuel-fired boiler for performing low-NOx combustion, comprising:

a fuel burner that injects powdered solid-fuel and air into a furnace, wherein the fuel burner comprises:

a coal primary port that injects the powdered solid-fuel and primary air into the furnace, and the coal primary port having a flame stabilizer mechanism for performing internal flame stabilization, and a secondary port that injects secondary air, the secondary port being provided so as to surround the coal primary port, wherein the flame stabilizer mechanism includes a plurality of splitting members arranged in a plurality of directions at a frontmost end of a flow-path of the coal primary port, the frontmost end of the flow-path of the coal primary port being located at an end of the burner closest to an interior of the furnace in the flow direction;

wherein the plurality of the splitting members intersect one another at right angles at the frontmost end of the flow-path of the coal primary port such that a plurality of crossing parts at which the splitting members intersect are disposed at the frontmost end of the flow-path of the coal primary port, wherein the plurality of splitting members are disposed in the vicinity of the center of an outlet opening of the fuel burner, and wherein the coal primary port and the secondary port are configured to inject the primary air and the secondary air into the furnace to generate a first air flow and a second air flow in the furnace respectively, the first air flow and the second air flow being parallel to each other.

2. A solid-fuel-fired burner according to claim 1, wherein the fuel burner is configured such that an ignition surface length (Lf) constituted by the splitting members is larger than an outlet opening circumferential length (L) of the fuel burner (Lf>L).

3. A solid-fuel-fired burner according to one of claim 1, further comprising: secondary-air injection ports that are disposed above and below and/or on the right and left sides of the fuel burner, each of the secondary-air injection ports is provided with an independent flow path having an airflow adjustment device.

4. A solid-fuel-fired burner according to claim 3, wherein the solid-fuel-fired burner is configured to feedback-control the airflow adjustment device such that has been inserted a distribution of an amount of air that is injected from the secondary-air injection ports is based on an amount of unburned fuel and an amount of nitrogen oxide (NOx) emission.

5. A solid-fuel-fired burner according to claim 3, wherein the solid-fuel-fired burner includes an additional-air injection section and an amount of air that is injected from the secondary-air injection ports is configured to be distributed among the secondary-air injection ports and the additional-air injection section, such that a reduction combustion zone extending from the burner section to the additional-air injection section and a perfect combustion zone disposed on a downstream side of the additional-air injection section are formed.

6. A solid-fuel-fired burner according to claim 3, further comprising a first supply line for supplying air to the secondary port of the fuel burner and a second supply line for supplying air to the secondary-air injection ports, wherein the first supply line and the second supply line are branched from an air supply duct for supplying the secondary-air.

7. A solid-fuel-fired burner according to claim 1, further comprising a flow adjustment device that applies a pressure loss to a flow of the powdered fuel and air provided at an up stream side of the splitting members.

8. A solid-fuel-fired burner according to claim 1, further comprising: secondary-air injection ports, wherein the secondary-air injection ports are disposed concentrically around the fuel burner, which has a circular shape, in an outer circumferential direction, wherein the flow path of each of the secondary-air injection ports is provided with an airflow adjustment device for adjusting the flow.

9. A solid-fuel-fired burner according to claim 1, wherein the splitting members have a triangular shape in a cross-section taken along the flow-path of the coal primary port.

10. A solid-fuel-fired burner according to claim 1, wherein the first air flow and the second air flow are each a straight flow parallel to an axial direction of the coal primary port.

11. A solid-fuel-fired burner according to claim 1, wherein the coal primary port has a rectangular shape, the secondary port has a rectangular shape, and the splitting members have a triangular shape in cross section.

12. A solid-fuel-fired burner according to claim 1, wherein each of the splitting members has a closed widened end that faces the interior of the furnace, and the closed widened end aligning with the frontmost end of the coal primary port.

13. A solid-fuel-fired boiler comprising:

a solid-fuel-fired burner that is disposed at a corner or on a wall of a furnace in a burner section of the solid-fuel-fired boiler for performing low-NOx combustion in the burner section, wherein the solid-fuel-fired burner comprises:

a fuel burner that injects powdered solid-fuel and air into the furnace, wherein the fuel burner comprises:

a coal primary port that injects the powdered solid-fuel and primary air into the furnace, and the coal primary port having a flame stabilizer mechanism for performing internal flame stabilization, and a secondary port that injects secondary air, and the secondary port being provided so as to surround the coal primary port, wherein the flame stabilizer mechanism includes a plurality of splitting members arranged in a plurality of directions at a frontmost end of a flow-path of the coal primary port, the frontmost end of the flow-path of the coal primary port being located at an end of the burner closest to an interior of the furnace in the flow direction;

wherein the plurality of the splitting members intersect one another at right angles at the frontmost end of the flow-path of the coal primary port such that a plurality of crossing parts at which the splitting members intersect are disposed at the frontmost end of the flow-path of the coal primary port, wherein the plurality of splitting members are disposed in the vicinity of the center of an outlet opening of the fuel burner, and wherein the coal primary port and the secondary port are configured to inject the primary air and the secondary air into the furnace to generate a first air flow and a second air flow in the furnace respectively, the first air flow and the second air flow being parallel to each other.

14. A solid-fuel-fired boiler according to claim 13, wherein the splitting members have a triangular shape in a cross-section taken along the flow-path of the coal primary port.

15. A solid-fuel-fired boiler according to claim 13, wherein the first air flow and the second air flow are each a straight flow parallel to an axial direction of the coal primary port.

16. A solid-fuel-fired boiler according to claim 13, wherein the coal primary port has a rectangular shape, the secondary port has a rectangular shape, and the splitting members have a triangular shape in cross section.

17. A solid-fuel-fired boiler according to claim 13, wherein each of the splitting members has a closed widened end that faces the interior of the furnace, and the closed widened end aligning with the frontmost end of the coal primary port.

* * * * *